US007396640B2

(12) United States Patent
Sakai

(10) Patent No.: US 7,396,640 B2
(45) Date of Patent: Jul. 8, 2008

(54) SILVER HALIDE COLOR PHOTOGRAPHIC LIGHT-SENSITIVE MATERIAL

(75) Inventor: Hidekazu Sakai, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/727,540

(22) Filed: Mar. 27, 2007

(65) Prior Publication Data

US 2007/0231753 A1 Oct. 4, 2007

(30) Foreign Application Priority Data

Mar. 28, 2006 (JP) ..... 2006-088673

(51) Int. Cl.

| | |
|---|---|
| ***G03C 1/46*** | (2006.01) |
| ***G03C 1/06*** | (2006.01) |
| ***G03C 1/76*** | (2006.01) |
| ***G03C 1/005*** | (2006.01) |
| ***G03C 1/494*** | (2006.01) |

(52) U.S. Cl. ..... 430/502; 430/503; 430/504; 430/505; 430/506; 430/567; 430/605; 430/523

(58) Field of Classification Search ..... 430/502–506, 430/567, 523, 604, 605
See application file for complete search history.

(56) References Cited

U.S. PATENT DOCUMENTS

| | | | | |
|---|---|---|---|---|
| 4,840,878 | A | 6/1989 | Hirose et al. | |
| 2007/0172778 | A1 * | 7/2007 | Sakai et al. | 430/546 |

FOREIGN PATENT DOCUMENTS

| | | |
|---|---|---|
| JP | 11-95371 | 4/1999 |

* cited by examiner

*Primary Examiner*—Geraldina Visconti
(74) *Attorney, Agent, or Firm*—Sughrue Mion, PLLC

(57) ABSTRACT

A silver halide color photographic light-sensitive material, which is for use in movie projection, and which has: on a transparent support, at least three light-sensitive silver halide emulsion layers which are different from each other in color developability and color sensitivity; and at least one non-light-sensitive hydrophilic colloid layer, wherein the light-sensitive silver halide emulsion layer nearest to the support includes silver halide emulsion grains having a silver chloride content of 95 mol % or more, wherein the silver halide color photographic light-sensitive material further contains at least one non-light-sensitive hydrophilic colloid layer containing black colloidal silver between the support and the light-sensitive silver halide emulsion layer nearest to the support, and wherein an amount of Fe in the silver halide color photographic light-sensitive material is $6\times10^{-5}$ mol/m$^2$ or less.

6 Claims, No Drawings

SILVER HALIDE COLOR PHOTOGRAPHIC LIGHT-SENSITIVE MATERIAL

FIELD OF THE INVENTION

The present invention relates to a silver halide color cinematographic light-sensitive material that can be processed in an exposure and processing system that is simplified and shortened.

BACKGROUND OF THE INVENTION

Cinematography, which is an application of silver halide photography, is a method of obtaining moving images by sequential 24-sheets-per-second projection of elaborate still images, and cinematography delivers overwhelmingly high-quality images, compared with other methods for reproducing moving images. By utilizing the high quality of cinematographic images as an asset, the images can be easily projected on a giant screen. As such, these moving images are suitable for simultaneous viewing by a large number of people. Under these circumstances, numerous theaters having motion picture projecting apparatus and large seating capacity have been built. On the other hand, explosive developments of electronic technology and information processing technology in recent years have enabled the advent of projectors using DMD devices of Texas Instrument Incorporated, D-ILA devices of Hughes-JVC Technology Corp., or high-definition liquid crystal devices of Sony Corporation, to provide more convenient tools for reproducing moving images of near-motion-picture quality. Therefore, it is also required that convenience and facilitation, especially simplification, time-reduction, and processing stability, of operations such as, exposure and development in photo laboratories, be conferred upon motion picture films while maintaining their high image qualities.

In silver halide photographic light-sensitive materials, reduction of development processing time has been taken up as an important object, and, many studies concerning silver halide emulsions having high developing rates, couplers having high coupling activity, and processing agents enabling rapid-development, have been carried out. In particular, use of a silver halide emulsion having a high silver chloride content is an effective means for improving rapid processing of color photographic light-sensitive material (for example, see U.S. Pat. No. 4,840,878).

As one factor responsible for the complexity and difficulty of developing operations of silver halide light-sensitive materials for use in motion-picture projection (screening), the presence of development for sound can be cited.

Since the invention of the motion pictures, various attempts to accompany pictures with sound have been made. As to an important property of the sound of motion pictures, imagery and sound are required to be in synchrony. To achieve synchronization with simplicity and reliability, ideally, image information and sound information should be recorded concurrently on one projection film. Against the backdrop as mentioned above, the technique of optically recording sound on projection films was developed in the 1920s. The dominant projection films in those days were black-and-white (B/W) light-sensitive materials forming images of developed silver. The developed silver absorbs light in a wide wavelength region, from ultraviolet light to infrared light; thus, in the case of recording sound information by the developed silver, the optical reading apparatus has no particular restriction as to the wavelength region for reading. Therefore, the reading apparatus used was one having a maximum sensitivity in the region of 800 nm to 900 nm, which was easy to commercialize with the techniques of that time.

Color-developed dyes forming color images in silver halide color light-sensitive materials for movie projection purpose, which material were commercialized from then on, have no absorption in the near infrared region. However, no change was made to the systems for reading sound signals from the time of development to the present day, and sound signals are still recorded as silver images in the current silver halide color light-sensitive materials for movie projection. On the other hand, the developed silver in the image areas of silver halide color light-sensitive materials for movie projection is removed in a processing step, out of necessity to enhance color purity.

As described above, about silver halide color photographic light-sensitive materials for movie projection, both a dye image, which requires no silver image, and a sound signal, which is unavoidably formed by use of a silver image, are present in one material. Therefore, in the process of developing a silver halide color photographic light-sensitive material for movie projection, it was necessary to perform complicated operations, such as coating a special developing solution only onto an area wherein a sound signal was recorded (the so-called soundtrack), in the middle of the process. Thus, the number of necessary steps reached 12, which was the number of steps necessary in the ECP-2D process disclosed by Eastman Kodak Co. Thus it is unavoidable to say that the number is large, considering that the number of steps for developing a silver halide color photographic paper, which is also used for image appreciation as in the case for the silver halide color photographic light-sensitive material for movie projection, is only three. Thus, a large burden is imposed on processing laboratories.

In order to make the process simple, various methods have been investigated; in particular, methods for forming a soundtrack in the same step for forming a dye image have been investigated. Out of the methods, attempts for improving a system for reading out sound signals have been promoted. A representative example thereof is the technique of forming soundtracks from developed cyan dyes, which is referred to as "cyan dye sound" (details of which were presented in a paper entitled "Red LED Reproduction of Cyan Stereo Variable Area Dye Track" at the SMPTE Technical Conference and World Media Expo (1996)). This technique permits the use of preexisting color light-sensitive materials for movie projection, and further, the adoption thereof requires photo laboratories to add almost no modifications to their existing facilities. The modification of the sound reading system has been advancing mainly in USA, and the system has been spreading.

In a cyan dye sound system, sound signals are recorded by use of dye images in the same way as the image area. Thus, any developed silver image is unnecessary. It is therefore unnecessary to perform a step required for forming silver images for the sound signals in the processing process. Thus, the number of necessary steps can be made small.

Furthermore, the unnecessity of formation of silver images for sound signals gives influences on designing composition of silver halide color photographic light-sensitive materials for movie projection.

About silver halide color photographic light-sensitive materials for movie projection, images on which are enlarged and projected for appreciation, sharpness is an important factor required for image quality. In order to improve sharpness, it is effective to prevent irradiation and halation. In order to prevent, in particular, halation, it is effective to form a colored layer between the support and a silver halide emulsion layer. A performance required for this colored layer is that the layer becomes colorless after the material is developed. Examples of the colorant that decolorizes in development include black colloidal silver and a solid dispersion of a dye dissoluble under alkaline conditions. Black colloidal silver is put to practical use in silver halide color photographic light-sensitive materials for photographing, and the like, since the black colloidal silver can be easily decolorized in photographic processing steps. However, in silver halide color photographic light-sensitive materials for movie projection, black colloidal silver cannot be used since sound signals are to be formed by utilizing silver images as described above. Accordingly, at present, a solid dispersion of a dye, which takes a longer time to decolorize, is used (see, for example, JP-A-11-95371 ("JP-A" means unexamined published Japanese patent application)). In the cyan dye sound system, sound signals are made of dye images; thus, black colloidal silver can also be used in silver halide color photographic light-sensitive materials for movie projection about which the use of a cyan dye sound system is premised.

SUMMARY OF THE INVENTION

The present invention resides in a silver halide color photographic light-sensitive material, which is for use in movie projection, which comprises:

on a transparent support, at least three kinds of light-sensitive silver halide emulsion layers that are different from each other in color developability and color sensitivity and which three kinds of layers include at least one yellow color-forming light-sensitive silver halide emulsion layer, at least one cyan color-forming light-sensitive silver halide emulsion layer, and at least one magenta color-forming light-sensitive silver halide emulsion layer, respectively, and at least one non-light-sensitive hydrophilic colloid layer, wherein, among the light-sensitive silver halide emulsion layers, the layer nearest to the support includes silver halide emulsion grains having a silver halide composition of silver chlorobromide, silver chloroiodide, silver chloroiodobromide, or silver chloride, each having a silver chloride content of 95% or more by mol, wherein the silver halide color photographic light-sensitive material further comprises at least one non-light-sensitive hydrophilic colloid layer containing black colloidal silver between the support and the light-sensitive silver halide emulsion layer nearest to the support, and wherein an amount of Fe in the silver halide color photographic light-sensitive material is $6\times10^{-5}$ mol/m$^2$ or less.

Other and further features and advantages of the invention will appear more fully from the following description.

DETAILED DESCRIPTION OF THE INVENTION

First, the present invention provides a silver halide color photographic light-sensitive material for movies which is applicable to a system wherein sound signals are recorded by means of using dye images, such as a cyan dye sound system, and can be subjected to a simple developing process. Second, the present invention provides a silver halide color photographic light-sensitive material for movies which can be stably developed even by a simplified processing step. Third, the present invention provides a silver halide color photographic light-sensitive material for movies which can decrease environmental loads by the simplification of the processing steps.

According to the present invention, the following means are provided:

<1> A silver halide color photographic light-sensitive material, which is for use in movie projection, which comprises:

on a transparent support, at least three kinds of light-sensitive silver halide emulsion layers that are different from each other in color developability and color sensitivity and which three kinds of layers include at least one yellow color-forming light-sensitive silver halide emulsion layer, at least one cyan color-forming light-sensitive silver halide emulsion layer, and at least one magenta color-forming light-sensitive silver halide emulsion layer, respectively, and at least one non-light-sensitive hydrophilic colloid layer, wherein, among the light-sensitive silver halide emulsion layers, the layer nearest to the support includes silver halide emulsion grains having a silver halide composition of silver chlorobromide, silver chloroiodide, silver chloroiodobromide, or silver chloride, each having a silver chloride content of 95% or more by mol, wherein the silver halide color photographic light-sensitive material further comprises at least one non-light-sensitive hydrophilic colloid layer containing black colloidal silver between the support and the light-sensitive silver halide emulsion layer nearest to the support, and wherein an amount of Fe in the silver halide color photographic light-sensitive material is $6\times10^{-5}$ mol/m$^2$ or less.

<2> The silver halide color photographic light-sensitive material according to item <1>, wherein the amount of Fe in the silver halide color photographic light-sensitive material is $8\times10^{-6}$ mol/m$^2$ or less.

<3> The silver halide color photographic light-sensitive material according to item <1> or <2>, wherein each of the light-sensitive silver halide emulsion layers includes silver halide emulsion grains having a silver halide composition of silver chlorobromide, silver chloroiodide, silver chloroiodobromide, or silver chloride, each having a silver chloride content of 95% or more by mol.

<4> The silver halide color photographic light-sensitive material according to item <1>, <2>, or <3>, wherein the silver halide emulsion layer nearest to the support is adjacent to the non-light-sensitive hydrophilic colloid layer containing the black colloidal silver.

The inventors have made intensive investigations about the above-mentioned problems and found out that: about a silver halide color photographic light-sensitive material for movies wherein a colloidal silver colored layer for preventing halation is formed based on the premise of the application of dye soundtrack, fluctuation of density of white portion after the material is processed becomes large; this density fluctuation is remarkable in the silver halide color photographic light-sensitive material which uses a silver halide emulsion having a high silver chloride content; this density fluctuation depends on the amount of Fe in the light-sensitive material; and the fluctuation can be restrained by decreasing the amount of Fe. Thus, the invention has been made. For reference, JP-A-2003-172984 discloses that the amount of Fe produces an effect on the photographic performance of silver halide color photographic light-sensitive materials for movies. However, the document is silent about any change of the density of a white portion, in particular, any change when a colloidal silver containing layer is introduced into the light-sensitive material.

First, the silver halide emulsion for use in the silver halide photographic light-sensitive material of the present invention is described herein. In the present invention, the silver halide emulsion grains in the light-sensitive silver halide emulsion layer nearest to the support has the silver chloride content of 95% or more by mol. In order to promote the color development of the light-sensitive material, it is preferred that the silver halide emulsion grains contained in all of the light-sensitive silver halide emulsion layers have the silver chloride content of 95% or more by mol, respectively. The silver halide composition of the silver halide emulsion grains is silver chloride, silver chlorobromide, silver chloroiodide, or silver chloroiodobromide, each having a silver chloride content of 95% or more by mol. The silver chloride content in the silver halide emulsion grains is preferably 98% or more by mol. The surface of the silver chloride grains may have a silver bromide localized phase. About the silver halide composition of the localized phase, the silver bromide content is preferably at least 10% by mol, more preferably more than 20% by mol. Also, a tabular grain having a (111) plane or a (100) plane as its principal plane may be used. The tabular high-silver-chloride emulsion grains having a (111) plane or a (100) plane as its principal plane may be prepared by the methods disclosed in JP-A-6-138619, U.S. Pat. Nos. 4,399,215, 5,061,617, 5,320,938, 5,264,337, 5,292,632, 5,314,798, and 5,413,904, WO94/22051, and the like.

In the silver halide emulsion for use in the present invention, any of various polyvalent metal ion impurities may be introduced in the step of forming emulsion grains, or ripening the grains physically. Preferably, an iridium compound is incorporated thereinto. In this case, it is known that reciprocity characteristics are improved. As the iridium compound, a six-coordination complex having 6 ligands and containing iridium as a central metal is preferable, for uniformly incorporating iridium in a silver halide crystal. As one appropriate mode of iridium compound for use in the present invention, a six-coordination complex having Cl, Br or I as a ligand and containing iridium as a central metal is preferable. A more preferable example is a six-coordination complex in which all six ligands are Cl, Br, or I and which has iridium as a central metal. In this case, Cl, Br and I may coexist in the six-coordination complex.

Another appropriate mode of the iridium compound that can be used in the present invention, a six-coordination complex having at least one ligand other than a halogen or a cyan and containing iridium as a central metal, is preferable. A six-coordination complex having $H_2O$, OH, O, OCN, thiazole or a substituted thiazole as a ligand and containing iridium as a central metal is preferable. A six-coordination complex in which at least one ligand is $H_2O$, OH, O, OCN, thiazole or substituted thiazole and the remaining ligands are Cl, Br or I, and iridium is a central metal, is more preferable. A six-coordination complex in which one or two ligands are 5-methylthiazole and the remaining ligands are Cl, Br or I, and iridium is a central metal, is most preferable.

These iridium complexes are added in amounts of, preferably $1\times10^{-10}$ mole to $1\times10^{-3}$ mole, most preferably $1\times10^{-8}$ mole to $1\times10^{-5}$ mole, per mole of silver, during grain formation.

In the present invention, a metal ion other than iridium can be doped in the inside and/or on the surface of the silver halide grains. The word "to dope" in the specification means "to intentionally add a small amount of a metal ion in order to change the property of a dope-receiving material largely or to control the property". The metal ions to be used are preferably ions of a transition metal. Preferable examples of the transition metal are iron, ruthenium, osmium, lead, cadmium, and zinc. It is more preferable that these metal ions are used in the form of a six-coordination complex of octahedron-type having ligands. When employing an inorganic compound as a ligand, cyanide ion, halide ion, thiocyanate ion, hydroxide ion, peroxide ion, azide ion, nitrite ion, water, ammonia, nitrosyl ion, or thionitrosyl ion is preferably used. Such a ligand is preferably coordinated to any metal ion selected from the group consisting of the above-mentioned iron, ruthenium, osmium, lead, cadmium and zinc. Two or more kinds of these ligands are also used in one complex molecule. Further, an organic compound can also be used as a ligand. Preferable examples of the organic compound include chain compounds having a main chain of 5 or less carbon atoms and/or heterocyclic compounds of 5- or 6-membered ring. More preferable examples of the organic compound are those having a nitrogen, phosphorus, oxygen, or sulfur atom in their respective molecules as an atom which is capable of coordinating to a metal. Most preferred organic compounds are furan, thiophene, oxazole, isoxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

As a combination of the metal ion and the ligand, a combination of an iron ion and a cyanide ion and a combination of a ruthenium ion and a cyanide ion (ligand) are preferable. In the present invention, it is preferable to use these compounds and the iridium in combination. In the present invention, preferred of these compounds are those in which the number of cyanide ions accounts for the majority of the coordination number (site) intrinsic to the iron or ruthenium that is the central metal. The remaining sites are preferably occupied by thiocyan, ammonia, water, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. Such metal complexes composed of these cyanide ion ligands are preferably added during grain formation in an amount of $1\times10^{-8}$ mol to $1\times10^{-2}$ mol, most preferably $1\times10^{-6}$ mol to $5\times10^{-4}$ mol, per mol of silver atom. In the case where ruthenium or osmium is used as a central metal, nitrosyl ion, thionitrosyl ion, or water molecule is also preferably used in combination with chloride ion, as ligands. More preferably these ligands form a pentachloronitrosyl complex, a pentachlorothionitrosyl complex, or a pentachloroaquo complex. The formation of a hexachloro complex is also preferred. These complexes are preferably added during grain formation in an amount of $1\times10^{-10}$ mol to $1\times10^{-6}$ mol, more preferably $1\times10^{-9}$ mol to $1\times10^{-6}$ mol, per mol of silver atom.

In the silver halide color light-sensitive material of the present invention, Fe is brought mainly from gelatin, dyes, and emulsion grains intentionally doped with Fe. In the light-sensitive material of the present invention, the Fe amount, that is Fe content, is $6\times10^{-5}$ mol/m$^2$ or less (preferably from $1\times10^{-8}$ to $6\times10^{-5}$ mol/m$^2$), preferably $8\times10^{-6}$ mol/m$^2$ or less (preferably from $1\times10^{-8}$ to $8\times10^{-6}$ mol/m$^2$), most preferably $3\times10^{-6}$ mol/m$^2$ or less (preferably from $1\times10^{-8}$ to $3\times10^{-6}$ mol/m$^2$).

If the Fe amount is too much, fluctuation of density of white portion becomes large. It has been ascertained that desired properties can be expressed at the first time in the present invention by specifying this Fe amount.

The silver halide emulsion for use in the present invention is generally subjected to chemical sensitization. As to the chemical sensitization method, sulfur sensitization typified by the addition of an unstable sulfur compound, noble metal sensitization typified by gold sensitization, and reduction sensitization may be used independently or in combination. As compounds used for the chemical sensitization, those described in JP-A-62-215272, page 18, right lower column to page 22, right upper column are preferably used.

The silver halide emulsion for use in the present invention is preferably subjected to gold sensitization as is known in this industrial field. This is because the gold sensitization can further decrease a variation (fluctuation) in the photographic properties which occurs when scanning exposure is performed using laser light or the like. To carry out gold sensitization, a compound such as chloroauric acid or its salt, or gold thiocyanates or gold thiosulfates may be used. The amount of each of these compounds to be added is preferably $5\times10^{-7}$ to $5\times10^{-3}$ mol and more preferably $1\times10^{-6}$ to $1\times10^{-4}$ mol per one mol of silver halide, though it may be changed in a wide range according to the case. In the present invention, gold sensitization may be used in combination with other sensitizing method, for example, sulfur sensitization, selenium sensitization, tellurium sensitization, reduction sensitization, or noble metal sensitization using a noble metal other than a gold compound; and such a mode is preferable in the present invention.

The silver halide emulsion for use in the present invention may contain various compounds for the purpose of preventing fogs during the production steps, storage and photographic processing of the emulsion or the light-sensitive material, or for the purpose of stabilizing the photographic properties. Namely, many compounds known as the antifoggant or stabilizer may be added. Examples of these compounds include azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiaidiazoles, aminotriazoles, benzotriazoles, nitrobenzotriazoles, mercaptotetrazoles (particularly, 1-phenyl-5-mercaptotetrazole and the like), mercaptopyrimidines, mercaptotriazines; thioketo compounds, e.g., oxadoline thion; azaindenes, e.g., triazaindenes, tetrazaindenes (particularly, 4-hydroxy substituted (1,3,3a,7) tetrazaindene), pentazaindenes; benzenethiosulfonic acid, benzenesulfinic acid, benzenesulfonic acid amide. Particularly preferable compounds are mercaptotetrazoles. These mercaptotetrazoles are preferable since they have the ability to further improve sensitivity at high illumination intensity, in addition to the aforementioned abilities of preventing fogging and improving the stability.

The sphere equivalent diameter as the average grain size of the silver halide grains contained in the green sensitive silver halide emulsion in the present invention is preferably 0.25 μm or less (preferably from 0.05 to 0.25 μm), more preferably 0.20 μm or less (preferably from 0.05 to 0.20 μm), even more preferably 0.18 μm or less (preferably from 0.05 to 0.18 μm). A grain having a sphere equivalent diameter of 0.40 μm, 0.3 μm, or 0.20 μm corresponds to a cubic grain having a side length of about 0.32 μm, about 0.24 μm, or about 0.16 μm, respectively. The average grain size of the green sensitive silver halide emulsion is one of main factors for deciding the granularity of magenta grains, which have the highest luminosity factor. Thus, reduction of the average grain size is an important factor for higher image quality. It is known that as the size of grains is made smaller, the developing speed can be generally made faster, which is also better from the viewpoint of an improvement in processing stability. When small size grains are prepared, in particular, when high silver chloride grains having a size in the above-mentioned size range are prepared, it is difficult to stably prepare uniform grains. In other words, when preparing high silver chloride grains having a grain size in the above-mentioned grain size range, which have a high solubility, it is preferred to always prevent dissolution of the grains in individual steps from the formation of the grains to the coating thereof.

The silver halide grains for use in the present invention are preferably monodispersion for the purpose of accelerating the development progress. A coefficient of variation in the grain size of each silver halide grain is preferably 0.3 or less (more preferably 0.3 to 0.05) and more preferably 0.25 or less (more preferably 0.25 to 0.05). The coefficient of variation so-called here is expressed by the ratio (s/d) of the value (s) of statistical standard deviation to the average grain size (d).

The silver halide photographic emulsions that can be used in the present invention may be prepared, for example, by the methods described in Research Disclosure (hereinafter abbreviated to as RD) No. 17643 (December 1978), pp. 22-23, "I. Emulsion preparation and types", and ibid. No. 18716 (November 1979), p. 648, and ibid. No. 307105 (November, 1989), pp. 863-865; the methods described by P. Glafkides, in Chemie et Phisique Photographique, Paul Montel (1967), by G. F. Duffin, in Photographic Emulsion Chemistry, Focal Press (1966), and by V. L. Zelikman et al., in Making and Coating of Photographic Emulsion, Focal Press (1964).

Monodispersed emulsions described in U.S. Pat. Nos. 3,574,628, and 3,655,394, and U.K. Patent No. 1,413,748 are also preferable. Tabular grains having an aspect ratio of about 3 or more can also be used in the present invention. Tabular grains may be prepared easily, according to the methods described by Gutoff, in Photographic Science and Engineering, Vol. 14, pp. 248-257 (1970); U.S. Pat. Nos. 4,434,226, 4,414,310, 4,433,048, and 4,439,520, and U.K. Patent No. 2,112,157.

As to the crystal structure, a uniform structure, a structure in which the internal part and the external part have different halogen compositions, and a layered structure may be acceptable. Silver halides differing in composition may be joined with each other by epitaxial junction, and a silver halide may be joined with a compound other than silver halides, such as, silver rhodanate and lead oxide. Also, a mixture of grains having various crystal forms may be used.

Although the aforementioned emulsion may be any one of a surface latent image-type that forms a latent image primarily on the grain surface, an internal latent image-type that forms a latent image inside the grain, and another type of emulsion that forms a latent image both on the surface and inside the grain; but it must be a negative type emulsion in any case. Among the internal latent image type emulsions, an emulsion of a core/shell type internal latent image type emulsion, as described in JP-A-63-264740 may be used, and the preparation method of this emulsion is described in JP-A-59-133542. The thickness of the shell of this emulsion is preferably 3 to 40 nm, and particularly preferably 5 to 20 nm, though it differs depending on development process.

As the silver halide emulsion, generally, those provided with physical ripening, chemical ripening, and spectral sensitization are used. Additives to be used in these steps are described in RD Nos. 17643, 18716, and 307105. Their relevant parts are listed in a table described later.

In the light-sensitive material of the present invention, two or more types of emulsions differing in at least one feature among the grain size, the distribution of grain size, halogen composition, the shape of the grain, and the sensitivity, of the light-sensitive silver halide emulsion (particularly, emulsions differing in sensitivity), may be mixed and used in one layer; and such is a preferable embodiment of the present invention.

In the present invention, it is preferable to apply surface-fogged silver halide grains described in U.S. Pat. No. 4,082,553, internally fogged silver halide grains described in U.S. Pat. No. 4,626,498 and JP-A-59-214852, or colloidal silver, in light-sensitive silver halide emulsion layers and/or substantially non-light-sensitive hydrophilic colloid layers. The internally or surface-fogged silver halide grain means a silver halide grain which can be developed uniformly (non image-wise) regardless of whether it exists at a non-exposed portion or an exposed portion of the light-sensitive material. A method of preparing the internally or surface-fogged silver halide grain is described in U.S. Pat. No. 4,626,498 and JP-A-59-214852. Silver halides that form the internal nuclei of an internally fogged core/shell type silver halide grain may have different halogen compositions. As the internally or surface-fogged silver halide, any of silver chloride, silver chlorobromide, silver iodobromide and silver chloroiodobromide can be used. The average grain size of these fogged silver halide grains is preferably 0.01 to 0.75 μm, and particularly preferably 0.05 to 0.6 μm. The grain shape may be a regular grain shape. Although the emulsion may be a polydisperse emulsion, it is preferably a monodisperse emulsion (in which at least 95% in mass or in number of silver halide grains have grain diameters falling within a range of ±40% of the average grain diameter).

In the present invention, a 1-aryl-5-mercaptotetrazole compound, in an amount of preferably $1.0\times10^{-5}$ to $5.0\times10^{-2}$ mol, and more preferably $1.0\times10^{-4}$ to $1.0\times10^{-2}$ mol, per one mol of silver halide, is added to any one layer of the photographic structural layers: the light-sensitive silver halide emulsion layers and non-light-sensitive hydrophilic colloidal layers (intermediate layers and protective layers) disposed on the support; and the compound is preferably added to a silver halide emulsion layer. The addition of this compound in an amount falling in the above range further reduces contamination to the surface of a processed color photograph after continuous processing.

As the 1-aryl-5-mercaptotetrazole compound, preferred is one in which the aryl group at the 1-position is an unsubstituted or substituted phenyl group. Preferable specific examples of the substituent include an acylamino group (e.g., an acetylamino group and —$NHCOC_5H_{11}$(n)), a ureido group (e.g., a methylureido group), an alkoxy group (e.g., a methoxy group), a carboxylic acid group, an amino group, and a sulfamoyl group. A plurality of groups (e.g. two to three groups) selected from these groups may be bonded with the phenyl group. Also, the position of the substituent is preferably the meta or para position. Specific examples of the compound include 1-(m-methylureidophenyl)-5-mercaptotetrazole and 1-(m-acetylaminophenyl)-5-mercaptotetrazole.

Black colloidal silver according to the present invention is not limited to a colloidal silver whose absorption in the range of visible ray wavelengths substantially does not change, but includes, for example, colloidal silver with brownish gray. In short, black colloidal silver may be any colloidal silver having a function of preventing halation.

The process for producing black colloidal silver may be a known method, for example, a method of reducing a soluble silver salt with hydroquinone in a gelation solution, as disclosed in U.S. Pat. No. 2,688,601; a method of reducing a slightly-soluble silver salt with hydrazine, as described in German Patent No. 1,096,193; a method of reducing into silver with tannic acid, as described in U.S. Pat. No. 2,921,914; or a method of forming silver grains by electroless plating, as described in JP-A-5-134358.

The coating amount of silver (coating silver amount) in the silver halide color photographic light-sensitive material of the present invention is preferably 6.0 g/$m^2$ or less, more preferably 4.5 g/$m^2$ or less, most preferably 2.0 g/$m^2$ or less. The coating amount of silver therein is preferably 0.02 g/$m^2$ or more, more preferably 0.05 g/$m^2$ or more, even more preferably 0.5 g/$m^2$ or more. The coating silver amount of black colloidal silver in the above coating silver amount is preferably from 0.01 to 2.0 g/$m^2$ (inclusive), more preferably from 0.02 to 2.0 g/$m^2$ (inclusive), even more preferably from 0.04 to 1.0 g/$m^2$ (inclusive).

The following will describe photographic layers of the silver halide color photographic light-sensitive material of the present invention for movie projection and other constituents of the material.

The silver halide color photographic light-sensitive material of the present invention is a silver halide color photographic light-sensitive material comprising a transparent support, and further comprising, over the support, at least three kinds of light-sensitive layers composed of plural silver halide emulsion layers substantially different from each other in color sensitivity. The present invention can be applied to any color photographic light-sensitive material for movie.

In the present invention, the number of the light-sensitive silver halide emulsion layers and the non-light-sensitive hydrophilic colloid layer(s) and the arrangement order of these layers are not particularly limited; however, the light-sensitive material comprises at least three light-sensitive silver halide emulsion layers which are different from each other in color developability and color sensitivity and which three light-sensitive silver halide emulsion layers include at least one yellow color-forming light-sensitive silver halide emulsion layer, at least one cyan color-forming light-sensitive silver halide emulsion layer, at least one magenta color-forming light-sensitive silver halide emulsion layer, respectively, and further the light-sensitive material comprises at least one non-light-sensitive hydrophilic colloid layer.

The relationship between color developability and color sensitivity of each of the color-forming light-sensitive silver halide emulsion layers is not particularly limited. For example, one of the color-forming light-sensitive silver halide emulsion layers may have color sensitivity in the range of infrared ray wavelengths or ultraviolet ray wavelengths.

In the present invention, the light-sensitive material comprises at least one layer of non-light-sensitive hydrophilic colloid layer containing black colloidal silver, between the support and the light-sensitive silver halide emulsion layer nearest to the support. The silver halide emulsion layer nearest to the support is preferably adjacent to the non-light-sensitive hydrophilic colloid layer containing black colloidal silver.

A typical example of the arrangement order of layers in the light-sensitive material is as follows: from the support side thereof, a non-light-sensitive hydrophilic colloid layer which contains black colloidal silver, a yellow color-forming light-sensitive silver halide emulsion layer, a non-light-sensitive hydrophilic colloid layer (color mixing inhibiting layer), a cyan color-forming light-sensitive silver halide emulsion layer, a non-light-sensitive hydrophilic colloid layer (color mixing-inhibiting layer), a magenta color-forming light-sensitive silver halide emulsion layer, and a non-light-sensitive hydrophilic colloid layer (protective layer). However, the arrangement order may be changed, or the number of the light-sensitive silver halide emulsion layers or the non-light-sensitive hydrophilic colloid layers may be increased or decreased, in accordance with the purpose of the light-sensitive material.

In the present invention, gelatin is preferably used as a hydrophilic colloid. Further, other hydrophilic colloid besides gelatin can also be used, if desired, with replacing gelatin in an arbitrary ratio. Examples include gelatin derivatives, graft polymers of gelatin with another polymer, proteins such as albumin and casein; cellulose derivatives, such as hydroxyethyl celluloses, carboxymethyl celluloses, and cellulose sulfates; saccharide, such as sodium alginates and starch derivatives; and various synthetic polymers, including polyvinyl alcohols, polyvinyl alcohol partial acetals, poly-N-vinylpyrrolidones, polyacrylic acids, polymethacrylic acids, polyacrylamides, polyvinylimidazoles, and polyvinylpyrazoles.

The photographic additives that can be used or can be used in combination in the present invention are described in the following Research Disclosures (RD), whose particular parts are given below in the following table.

TABLE 1

| | Kind of Additive | RD 17643 | RD 18716 | RD 307105 |
|---|---|---|---|---|
| 1 | Chemical sensitizers | p. 23 | p. 648 (right column) | p. 866 |
| 2 | Sensitivity-enhancing agents | | p. 648 (right column) | |
| 3 | Spectral sensitizers and Supersensitizers | pp. 23-24 | pp. 648 (right column)-649 (right column) | pp. 866-868 |
| 4 | Brightening agents | p. 24 | pp. 647 (right column) | p. 868 |
| 5 | Light absorbers, Filter dyes, and UV Absorbers | pp. 25-26 | pp. 649 (right column)-650 (left column) | p. 873 |
| 6 | Binders | p. 26 | p. 651 (left column) | pp. 873-874 |
| 7 | Plasticizers and Lubricants | p. 27 | p. 650 (right column) | p. 876 |
| 8 | Coating aids and Surfactants | pp. 26-27 | p. 650 (right column) | pp. 875-876 |
| 9 | Antistatic agents | p. 27 | p. 650 (right column) | pp. 876-877 |
| 10 | Matting agents | | | pp. 878-879 |

In the silver halide color photographic light-sensitive material of the present invention, the following dye-forming couplers are particularly preferably used, though various dye-forming couplers can be used:

Yellow couplers: couplers represented by the formula (I) or (II) in EP502,424A; couplers represented by the formula (1) or (2) in EP513,496A (particularly, Y-28 on page 18); couplers represented by the formula (1) in Claim 1 in JP-A-5-307248; couplers represented by the formula (I) in U.S. Pat. No. 5,066,576, column 1, line 45 to line 55; couplers represented by the formula (I) in JP-A-4-274425, Paragraph 0008; couplers described in Claim 1 in EP498,381A1, page 40 (particularly, D-35 on page 18); couplers represented by the formula (Y) in EP447,969A1, page 4 (particularly Y-1 (page 17) and Y-54 (page 41)); and couplers represented by one of the formulae (II) to (IV) in U.S. Pat. No. 4,476,219, column 7, line 36 to line 58 (particularly, II-17 and -19 (column 17) and II-24 (column 19)).

Magenta couplers: JP-A-3-39737 (L-57 (page 11, lower right), L-68 (page 12, lower right), L-77 (page 13, lower right)); A-4-63 (page 134), A-4-73 and -75 (page 139) in EP456,257; M-4, -6 (page 26) and M-7 (page 27) in EP486,965; M-45 in JP-A-6-43611, Paragraph 0024; M-1 in JP-A-5-204106, Paragraph 0036; M-22 in JP-A-4-362631, Paragraph 0237.

Cyan couplers: CX-1, 3, 4, 5, 11, 12, 14 and 15 (page 14 to page 16) in JP-A-4-204843; C-7, 10 (page 35), 34, 35 (page 37), (I-1), (I-17) (page 42 to page 43) in JP-A-4-43345; and couplers represented by the formula (Ia) or (Ib) in Claim 1 in JP-A-6-67385.

Polymer couplers: P-1 and P-5 (page 11) in JP-A-2-44345.

As couplers that form a color dye having suitable diffusion characteristics, those described in U.S. Pat. No. 4,366,237, GB 2,125,570, EP 96,873B, and DE 3,234,533 are preferable.

As couplers for compensating unnecessary absorption of color dye, yellow-colored cyan couplers represented by the formula (CI), (CII), (CIII) or (CIV) described on page 5 in EP456,257A1 (particularly YC-86, on page 84), yellow-colored magenta couplers ExM-7 (page 202), EX-1 (page 249) and Ex-7 (page 251) described in the same EP publication, magenta-colored cyan couplers CC-9 (column 8) and CC-13 (column 10) described in U.S. Pat. No. 4,833,069, and colorless masking couplers represented by the formula [C-1] described in Claim 1 in W092/11575 (particularly, the exemplified compounds on page 36 to page 45) and (2) (on column 8) of U.S. Pat. No. 4,837,136, are preferable.

Examples of the compound (including a dye-forming coupler) which reacts with an oxidized product of a developing agent to release a photographically useful compound residue, includes the followings:

Development inhibitor releasing compounds: compounds represented by the formula (I), (II), (III) or (IV) described in EP 378,236A1, page 11 (particularly T-101 (page 30), T-104 (page 31), T-113 (page 36), T-131 (page 45), T-144 (page 51) and T-158 (page 58)), compounds represented by the formula (I) in EP 436,938A2, page 7 (particularly, D-49 (page 51)), compounds represented by the formula (1) in JP-A-5-307248 (particularly, (23) in Paragraph 0027)) and compounds represented by the formula (I), (II) or (III) in EP 440,195A2, page 5 to page 6 (particularly, I-(1) on page 29)).

Bleaching-accelerator-releasing compounds: compounds represented by the formula (I) or (I') described in EP 310,125A2, page 5 (particularly (60) and (61) on page 61) and compounds represented by the formula (I) in Claim 1 in JP-A-6-59411 (particularly, (7) in Paragraph 0022).

Ligand-releasing compounds: compounds represented by LIG-X described in Claim 1 in U.S. Pat. No. 4,555,478 (particularly, compounds described in column 12, lines 21 to 41).

Leuco dye-releasing compounds: compounds 1 to 6 in U.S. Pat. No. 4,749,641, columns 3 to 8.

Fluorescent dye-releasing compounds: compounds represented by COUP-DYE in Claim 1 in U.S. Pat. No. 4,774,181 (particularly compounds 1 to 11 in columns 7 to 10).

Compounds, which release a development accelerator or fogging agent: compounds represented by the formula (1), (2) or (3) in U.S. Pat. No. 4,656,123, column 3 (particularly, (I-22) in column 25) and ExZK-2 in EP 450,637A2, page 75, line 36 to line 38.

Compounds which release a group that becomes a dye only after being spilt-off: compounds represented by the formula (I) in Claim 1 in U.S. Pat. No. 4,857,447 (particularly, Y-1 to Y-19 in columns 25 to 36).

As additives other than the dye-forming coupler, the following ones are preferable.

Dispersion media for an oil-soluble organic compound: P-3, 5, 16, 19, 25, 30, 42, 49, 54, 55, 66, 81, 85, 86 and 93 (page 140 to page 144) in JP-A-62-215272;

Latex for impregnation of oil-soluble organic compound: latex described in U.S. Pat. No. 4,199,363;

Scavengers for an oxidized product of a developing agent: compounds represented by the formula (I) in U.S. Pat. No. 4,978,606, column 2, line 54 to line 62 (particularly I-(1), (2), (6), (12) (columns 4 to 5)) and compounds represented by the formula in U.S. Pat. No. 4,923,787, column 2, line 5 to line 10 (particularly Compound 1 (column 3));

Stain preventive agents: compounds represented by one of the formulae (I) to (III) in EP 298321 A, page 4, line 30 to line 33 (particularly, I-47, 72, III-1, 27 (page 24 to page 48));

Anti-fading agents: A-6, 7, 20, 21, 23, 24, 25, 26, 30, 37, 40, 42, 48, 63, 90, 92, 94 and 164 (page 69 to page 118) in EP 298321A, and II-1 to III-23 in U.S. Pat. No. 5,122,444, columns 25 to 38 (particularly, III-10), I-1 to III-4 in EP 471347A, page 8 to page 12 (particularly, II-2), and A-1 to 48 in U.S. Pat. No. 5,139,931, columns 32 to 40 (particularly A-39 and 42);

Materials for reducing the amount to be used of a color development-enhancing agent or color contamination preventive agent: I-1 to II-15 in EP 411324A, page 5 to page 24 (particularly, I-46);

Formalin scavengers: SCV-1 to 28 in EP 477932A, page 24 to page 29 (particularly SCV-8);

Hardener: H-1, 4, 6, 8 and 14 in JP-A-1-214845 in page 17, compounds (H-1 to H-54) represented by one of the formulae (VII) to (XII) in U.S. Pat. No. 4,618,573, columns 13 to 23, compounds (H-1 to 76) represented by the formula (6) in JP-A-2-214852, page 8, lower right (particularly, H-14), and compounds described in Claim 1 in U.S. Pat. No. 3,325,287;

Development-inhibitor precursors: P-24, 37, 39 (page 6 to page 7) in JP-A-62-168139 and compounds described in claim 1 of U.S. Pat. No. 5,019,492 (particularly 28 to 29 in column 7);

Antiseptics and mildew-proofing agents: I-1 to III-43 in U.S. Pat. No. 4,923,790, columns 3 to 15 (particularly II-1, 9, 10 and 18 and III-25), Stabilizers and antifoggants: I-1 to (14) in U.S. Pat. No. 4,923,793, columns 6 to 16 (particularly, I-1, 60, (2) and (13)), and compounds 1 to 65 in U.S. Pat. No. 4,952,483, columns 25 to 32 (particularly, 36);

Chemical sensitizers: triphenylphosphine selenide and compound 50 in JP-A-5-40324;

Dyes: a-1 to b-20 on page 15 to page 18 (particularly, a-1, 12, 18, 27, 35, 36, b-5) and compounds V-1 to 23 on pages 27 to 29, (particularly, V-1) in JP-A-3-156450, F-I-1 to F-II-43 in EP 445627A, page 33 to page 55 (particularly F-I-11 and F-II-8), III-1 to 36 in EP 457153A, page 17 to page 28 (particularly III-1 and 3), compounds 1 to 22 in EP319999A, page 6 to page 11 (particularly, compound 1), compounds D-1 to 87 (page 3 to page 28) represented by one of the formulae (1) to (3) in EP 519306A, compounds 1 to 22 (columns 3 to 10) represented by the formula (I) in U.S. Pat. No. 4,268,622, compounds (1) to (31) (columns 2 to 9) represented by the formula (I) in U.S. Pat. No. 4,923,788;

UV absorbers: compounds (18b) to (18r) and 101 to 427 (page 6 to page 9) represented by the formula (I) in JP-A-46-3335, compounds (3) to (66) (page 10 to page 44) represented by the formula (I) and compounds HBT-1 to HBT-10 (page 14) represented by the formula (III) in EP 520938A and compounds (1) to (31) (columns 2 to 9) represented by the formula (1) in EP 521823.

The silver halide color photographic light-sensitive material of the present invention may advantageously contain a fluorine-containing compound in a layer remotest from the support on the side having emulsion layers or a layer remotest from the support on the side having no emulsion layer, or in both the layers. In particular, it is preferred that the compounds described in claim 2 in JP-A-2003-172984 be used.

In the silver halide color photographic light-sensitive material of the present invention, the sum of the film thicknesses of all hydrophilic colloidal layers on the side provided with the emulsion layers is preferably 28 μm or less, more preferably 23 μm or less, still more preferably 18 μm or less, and particularly preferably 16 μm or less. Further, the sum of the film thicknesses is generally 0.1 μm or more, preferably 1 μm or more, and more preferably 5 μm or more.

The film swelling rate $T_{1/2}$ is preferably 60 seconds or less, and more preferably 30 seconds or less. $T_{1/2}$ is defined as the time required until the film thickness reaches ½ the saturated film thickness which is 90% of the maximum swelled film thickness attained when the film is processed with a color-developer at 35° C. for 3 minutes. The term "film thickness" means a film thickness measured under controlled humid conditions of 25° C. and a relative humidity of 55% (2 days). $T_{1/2}$ can be measured using a swellometer of the type described by A. Green et al. in Photogr. Sci. Eng, Vol. 19, 2, page 124 to page 129. $T_{1/2}$ can be regulated by adding a hardener to a gelatin used as a binder, or by changing aging conditions after coating.

The rate of swelling is preferably 180 to 280%, and more preferably 200 to 250%. Here, the term "rate of swelling" means a standard showing the magnitude of equilibrium swelling when the silver halide photographic light-sensitive material of the present invention is immersed in 27° C. distilled water to swell the material, and it is given by the following equation:

$$\text{Rate of swelling (unit: \%)} = (\text{Total film thickness when swelled})/(\text{Total film thickness when dried}) \times 100.$$

The above rate of swelling can be made to fall in the above range by adjusting the amount of a gelatin hardener to be added.

The silver halide color photographic light-sensitive material of the present invention for movie projection can be processed through a standard processing process for positive light-sensitive materials for movie. The light-sensitive material can be preferably processed in a simplified processing process wherein the use of a cyan dye sound system is premised.

A conventional standard processing process (except a drying step) for positive light-sensitive materials for movie needs 12 steps described below:

(1) Color developing bath
(2) Stop bath
(3) Wash bath
(4) First fixing bath
(5) Wash bath
(6) Bleaching bath
(7) Wash bath
(8) Sound development (coating development)
(9) Wash bath
(10) Second fixing bath
(11) Wash bath
(12) Stabilizing bath The simplified processing process can be shortened into 8 steps described below since it is unnecessary to cause developed silver to remain in the soundtrack.

(1) Color developing bath
(2) Stop bath
(3) Wash bath
(4) Bleaching bath
(5) Wash bath
(6) Fixing bath
(7) Wash bath
(8) Stabilizing bath Furthermore, when a bleaching and fixing bath, which has a bleaching function and a fixing function together, is used, the processing process can be further shortened. Specifically, the process can be shortened into 6 steps by changing (4) bleaching bath to a bleaching and fixing bath and omitting (5) wash bath and (6) fixing bath.

In the present invention, particularly preferable effects can be attained when a rapid processing, in which, among the above processing processes, color developing time (the above step (1)) is preferably 2 minutes and 30 seconds or less (the lower limit is preferably 6 seconds or more, more preferably 10 seconds or more, further more preferably 20 seconds or more, and most preferably 30 seconds or more), and more preferably 2 minutes or less (the lower limit is the same to the case for the color development time of 2 minutes and 30 seconds), is conducted.

The support will be hereinafter explained.

In the present invention, as the support, a transparent support (a transmission type support) is preferable, and a plastic film support is more preferable. Examples of the plastic film support include films, for example, of a polyethylene terephthalate, a polyethylene naphthalate, a cellulose triacetate, a cellulose acetate butylate, a cellulose acetate propionate, a polycarbonate, a polystyrene, or a polyethylene.

Among these films, polyethylene terephthalate films are preferable and biaxially oriented (stretched) and thermally fixed polyethylene terephthalate films are particularly preferable in view of stability, toughness and the like.

The thickness of the support is generally 15 to 500 μm, preferably 40 to 200 μm in view of ease of handling and usability for general purposes, and most preferably 85 to 150 μm, though no particular limitation is imposed on the thickness of the above support.

The transmission type support means those through which preferably 90% or more visible light transmits, and the support may contain silicon, alumina sol, chrome salt or zirconium salt, which are made into a dye, to an extent that it does not substantially inhibit the transmission of light.

The following surface treatment is generally carried out on the surface of the plastic film support, to bond light-sensitive layers firmly with the surface. The surface on the side where an antistatic layer (backing layer) is formed is generally subjected to a surface treatment in the similar manner. Specifically, there are the following two methods:

(1) A method, in which a surface activating treatment, such as chemical treatment, mechanical treatment, corona discharge treatment, flame treatment, ultraviolet treatment, high-frequency treatment, glow discharge treatment, activated plasma treatment, laser treatment, mixed acid treatment, or ozone oxygen treatment, is carried out, and then a photographic emulsion (a coating solution for formation of a light-sensitive layer) is directly applied, to obtain adhesive force; and (2) A method, in which after the above surface treatment is once carried out, an undercoating layer is formed, and a photographic emulsion layer is applied onto the undercoating layer.

Among these methods, the method (2) is more effective and hence widely used. These surface treatments each are assumed to have the effects of: forming a polar group in some degree on the surface of the support, which is originally hydrophobic, removing a thin layer that gives an adverse effect on the adhesion of the surface, and increasing the crosslinking density of the surface, thereby increasing the adhesive force. As a result, it is assumed that, for example, the affinity of components contained in a solution of the undercoating layer to the polar group is increased and the fastness of the adhering surface is increased, thereby improving adhesion between the undercoating layer and the surface of the support.

It is preferable that a non-light-sensitive layer containing conductive metal oxide particles be formed, on the surface of the above plastic film support on the side provided with no light-sensitive layer.

As the binder for the above non-light-sensitive layer, an acrylic resin, vinyl resin, polyurethane resin or polyester resin is preferably used. The non-light-sensitive layer is preferably film-hardened. As the hardener, an aziridine-series, triazine-series, vinylsulfone-series, aldehyde-series, cyanoacrylate-series, peptide-series, epoxy-series, melamine-series compound or the like is used. Among these, a melamine-series compound is particularly preferable in view of fixing the conductive metal oxide particles firmly.

Examples of materials to be used for the conductive metal oxide particles may include ZnO, $TiO_2$, $SnO_2$, $Al_2O_3$, $In_2O_3$, MgO, BaO, $MoO_3$ and $V_2O_5$, composite oxides of these oxides, and metal oxides obtained by adding a different type of atom to each of these metal oxides.

As the metal oxide, $SnO_2$, ZnO, $Al_2O_3$, $TiO_2$, $In_2O_3$, MgO and $V_2O_5$ are preferable, $SnO_2$, ZnO, $In_2O_3$, $TiO_2$ and $V_2O_5$ are more preferable and $SnO_2$ and $V_2O_5$ are particularly preferable. Examples of the metal oxide containing a small amount of a different type of atom may include those obtained by doping each of these metal oxides with generally 0.01 to 30 mol % (preferably 0.1 to 10 mol %) of a different element, specifically, by doping ZnO with Al or In, $TiO_2$ with Nb or Ta, $In_2O_3$ with Sn, and $SnO_2$ with Sb, Nb or a halogen atom. When the addition amount of the different type of element is too small, only insufficient conductivity can be imparted to the oxide or the composite oxide, whereas when the addition amount is too large, the blackening of the particle is increased, leading to the formation of a blackish antistatic layer. This shows that the oxides containing a different type of element in the amount out of the above range are unsuitable for the light-sensitive material. Therefore, as materials of the conductive metal oxide particle, metal oxides or composite metal oxides containing a small amount of a different type of element are preferable. Those having an oxygen defect in a crystal structure are also preferable.

The conductive metal oxide particles preferably have a ratio by volume of 50% or less to the total non-light-sensitive layers, and more preferably 3 to 30%. The amount of the conductive metal oxide particles to be applied preferably follows the conditions described in JP-A-10-62905. When the volume ratio is too large, the surface of a processed color photograph is easily contaminated, whereas when the ratio is too small, the antistatic function is insufficiently performed.

It is preferable that the particle diameter of the conductive metal oxide particle be as smaller as possible, to decrease light scattering. However, it must be determined based on, as a parameter, the ratio of the refractive index of the particle to that of the binder, and it can be determined using the Mie's theory. Generally, the average particle diameter is preferably 0.001 to 0.5 μm, and more preferably 0.003 to 0.2 μm. The average particle diameter so-called here is a value including not only a primary particle diameter but also a particle diameter of higher-order structure of the conductive metal oxide particles.

When the fine particle of the aforementioned metal oxide is added to a coating solution for forming an antistatic layer, it may be added as it is and then dispersed therein. It is preferable to add the fine particle in the form of a dispersion solution in which the fine particle is dispersed in a solvent (including a dispersant and a binder according to the need) such as water.

Other useful examples of the electroconductive material used in the antistatic layer in the present invention include semiconductor metal salts, such as cuprous iodide, described in U.S. Pat. Nos. 3,245,833, 3,428,451, and 5,075,171; fibrous electroconductive powder containing tin oxide doped with antimony coated on non-electroconductive potassium titanate whisker, described in U. S. Pat. Nos. 4,845,369 and 5,116,666; electroconductive polymers, such as crosslinked vinylbenzyl quaternary ammonium polymer, described in U.S. Pat. No. 4,070,189; electroconductive polyanilines described in U.S. Pat. No. 4,237,194; electroconductive polythiophenes described in U.S. Pat. Nos. 4,987,042, 5,035,926, 5,354,613, 5,370,981, 5,372,924, 5,543,944, and 5,766,515; and colloid gel made of vanadium pentoxide or vanadium pentoxide doped with silver, described in U. S. Pat. Nos. 4,203,769, 5,006,451, 5,221,598 and 5,284,714.

The non-light-sensitive layer preferably contains a hardened product of the above binder and hardener, which product functions as a binder agent so as to disperse and support the above conductive materials. In the present invention, it is preferable that both of the binder and the hardener which are soluble in water or are in the state of a water dispersion, such as an emulsion, be used in view of maintaining a better working environment and preventing air pollution. Also, the binder preferably has any group among methylol group, hydroxyl group, carboxyl group and glycidyl group, to enable a crosslinking reaction with the hardener. A hydroxyl group and a carboxyl group are preferable and a carboxyl group is particularly preferable. The content of the hydroxyl or carboxyl group in the binder is preferably 0.0001 to 1 equivalent/1 kg and particularly preferably 0.001 to 1 equivalent/1 kg.

Preferable resins to be used as the binder will be hereinafter explained.

Examples of acrylic resins may include homopolymers of any one monomer of acrylic acid, acrylates, such as alkyl acrylates; acrylamides; acrylonitriles, methacrylic acid; methacrylates, such as alkyl methacrylates; methacrylamides and methacrylonitriles, and copolymers obtained by polymerizing two or more of these monomers. Among these polymers or copolymers, homopolymers of any one monomer of acrylates, such as alkyl acrylates, and methacrylates, such as alkyl methacrylates, or copolymers obtained by polymerization of two or more of these monomers, are preferable. Examples of these homopolymers or copolymers may include homopolymers of any one monomer of acrylates and methacrylates having an alkyl group having 1 to 6 carbon atoms, or copolymers obtained by the polymerization of two or more of these monomers.

The above acrylic resin is preferably a polymer obtained by using the above composition as its major components and by partially using a monomer having any group of, for example, methylol group, hydroxyl group, carboxyl group, and glycidyl group, so as to enable a crosslinking reaction with the hardener.

Preferable examples of the above vinyl resin include polyvinyl alcohol, acid-denatured polyvinyl alcohol, polyvinyl formal, polyvinyl butyral, polyvinyl methylether, polyolefin, ethylene/butadiene copolymer, polyvinyl acetate, vinyl chloride/vinyl acetate copolymer, vinyl chloride/(meth)acrylate copolymer, and ethylene/vinyl acetate-series copolymer (preferably an ethylene/vinyl acetate/(meth)acrylate copolymer). Among these, polyvinyl alcohol, acid-denatured polyvinyl alcohol, polyvinyl formal, polyolefin, ethylene/butadiene copolymer, and ethylene/vinyl acetate-series copolymer (preferably an ethylene/vinyl acetate/acrylate copolymer) are preferable.

In order for the above vinyl resin to be able to crosslink with the hardener, it is preferable that the polyvinyl alcohol, acid-denatured polyvinyl alcohol, polyvinyl formal, polyvinyl butyral, polyvinyl methylether, and polyvinyl acetate are respectively formed as a polymer having a hydroxyl group by, for example, leaving a vinyl alcohol unit in the polymer; and that the other polymers are respectively formed by partially using a monomer having any one group, for example, of a methylol group, hydroxyl group, carboxyl group and glycidyl group.

Examples of the above polyurethane resin may include polyurethanes derived from any one of a polyhydroxy compound (e.g., ethylene glycol, propylene glycol, glycerol, and trimethylol propane), an aliphatic polyester-series polyol obtained by a reaction between a polyhydroxy compound and a polybasic acid; a polyether polyol (e.g., poly(oxypropylene ether)polyol, poly(oxyethylene-propylene ether)polyol), a polycarbonate-series polyol, and a polyethylene terephthalate polyol; or those derived from a polyisocyanate and a mixture of the above. In the case of the above polyurethane resin, for instance, a hydroxyl group that is left unreacted after the reaction between the polyol and the polyisocyanate is completed, may be utilized as a functional group which can run a crosslinking reaction with the hardener.

As the above polyester resin, polymers obtained by a reaction between a polyhydroxy compound (e.g., ethylene glycol, propylene glycol, glycerol, and trimethylolpropane) and a polybasic acid are generally used. In the case of the above polyester resin, for instance, a hydroxyl group or carboxyl group that is left unreacted after the reaction between the polyol and the polybasic acid is completed, may be utilized as a functional group which can run a crosslinking reaction with the hardener. Of course, a third component having a functional group such as a hydroxyl group may be added.

Among the above polymers, acrylic resins and polyurethane resins are preferable and acrylic resins are particularly preferable.

Examples of the melamine compound preferably used as the hardener include compounds having two or more (preferably three or more) methylol groups and/or alkoxymethyl groups in a melamine molecule, melamine resins which are condensation polymers of the above compounds, and melamine/urea resins. Examples of initial condensation products of melamine and formalin include, though not limited to, dimethylolmelamine, trimethylolmelamine, tetramethylolmelamine, pentamethylolmelamine, and hexamethylolmelamine. Specific examples of commercially available products of these compounds may include, though not limited to, Sumitex Resins M-3, MW, MK and MC (trade names, manufactured by Sumitomo Chemical Co., Ltd.).

Examples of the above condensation polymer may include, though not limited to, a hexamethylolmelamine resin, trimethylolmelamine resin, trimethyloltrimethoxymethylmelamine resin, and the like. Examples of commercially available products of the polymer may include, though not limited to, MA-1 and MA-204 (trade names, manufactured by Sumitomo Bakelite), BECKAMINE MA-S, BECKAMINE APM and BECKAMINE J-101 (trade names, manufactured by Dainippon Ink and Chemicals Inc.), Yuroid 344 (trade name, manufactured by Mitsui Toatsu Chemicals), Oshika Resin M31 and Oshika Resin PWP-8 (trade names, manufactured by Oshika Shinko Co., Ltd.), and the like.

As the melamine compound, it is preferable that the functional group equivalence given by a value obtained by dividing its molecular mass by the number of functional groups in one molecule be 50 or more and 300 or less. Here, the functional group indicates a methylol group and/or an alkoxymethyl group. If this value is too large, only small cured density is obtained and hence high mechanical strength is not obtained in some cases, however, if the amount of the melamine compound is increased, the coatability is reduced. When the cured density is small, scratches tend to be caused. Also, if the level of curing is low, the force retaining the conductive metal oxide is also reduced. When the functional group equivalence is too small, the cured density is increased but the transparency is impaired, and even if the amount of the melamine compound is reduced, the condition is not bettered in some cases. The amount of an aqueous melamine compound to be added is generally 0.1 to 100 mass %, and preferably 10 to 90 mass %, to the aforementioned polymer.

If necessary, a matt agent, an electrification adjustor, a surfactant, a lubricant or the like may be used together in the antistatic layer. Examples of the matt agent include oxides such as silicon oxide, aluminum oxide, and magnesium oxide, each of which has a particle diameter of preferably from 0.001 to 10 μm, more preferably from 0.2 to 0.5 μm; and polymers or copolymers such as polymethyl methacrylate and polystyrene. The addition amount of the matt agent is preferably from 2 to 15 mg/m$^2$.

Examples of the electrification adjustor include surfactants described below, polymers containing fluorine atoms, inorganic salts, and organic salts. Particularly preferred are surfactants or polymers containing fluorine atoms, salts containing a tetraalkylammonium ion, or other compounds.

Given as examples of the surfactant are known surfactants, such as anionic surfactants, cationic surfactants, amphoteric surfactants, and nonionic surfactants.

Examples of the lubricant may include phosphates of higher alcohols having 8 to 22 carbon atoms or their amino salts; palmitic acid, stearic acid, and behenic acid, and their esters; silicone-series compounds, and the like.

The thickness of the aforementioned antistatic layer is preferably 0.01 to 1 μm, and more preferably 0.01 to 0.2 μm. When the thickness is too thin, coating nonuniformity tends to be caused on the resultant product since it is hard to apply a coating material uniformly. On the other hand, when the thickness is too thick, inferior antistatic ability and resistance to scratching can be caused sometimes.

It is preferable to dispose a surface layer on the above antistatic layer. The surface layer is provided primarily to improve lubricity and resistance to scratching, as well as to aid the ability to prevent the conductive metal oxide particles of the antistatic layer from desorbing.

Examples of materials for the above surface layer include (1) waxes, resins and rubber-like products comprising homopolymers or copolymers of I -olefin-series unsaturated hydrocarbons, such as ethylene, propylene, 1-butene, and 4-methyl-1-pentene (e.g., polyethylene, polypropylene, poly-1-butene, poly-4-methyl-1-pentene, ethylene/propylene copolymer, ethylene/1-butene copolymer, and propylene/1-butene copolymer), (2) rubber-like copolymers of two or more types of the above 1-olefin and a conjugated or non-conjugated diene (e.g., an ethylene/propylene/ethylidene norbornane copolymer, ethylene/propylene/1,5-hexadiene copolymer, and isobutene/isoprene copolymer), (3) copolymers of a 1-olefin and a conjugated or non-conjugated diene (e.g., an ethylene/butadiene copolymer and ethylene/ethylidene norbornane copolymer), (4) copolymers of a 1-olefin, particularly ethylene, and a vinyl acetate, and completely or partly saponified products of these copolymers, and (5) graft polymers obtained by grafting the above conjugated or non-conjugated diene or vinyl acetate on a homopolymer or copolymer of a 1-olefin, and completely or partly saponified products of these graft polymers. However, the materials for the surface layer are not limited to these compounds. The aforementioned compounds are described in JP-B-5-41656 ("JP-B" means examined Japanese patent publication).

Among these compounds, those being polyolefins and having a carboxyl group and/or a carboxylate group are preferable. These polyolefins are generally used in the form of an aqueous solution or a water dispersion solution.

An aqueous methyl cellulose of which the degree of methyl group substitution is 2.5 or less may be added in the surface layer, and the amount of the methyl cellulose to be added is preferably 0.1 to 40 mass % to the total binding agents forming the surface layer. The above aqueous methyl cellulose is described in JP-A-1-210947.

The above surface layer may be formed by applying a coating solution (water dispersion or aqueous solution) containing the aforementioned binder and the like, onto the antistatic layer, by using a generally well-known coating method, such as a dip coating method, air knife coating method, curtain coating method, wire bar coating method, gravure coating method, or extrusion coating method.

The thickness of the above surface layer is preferably 0.01 to 1 μm, and more preferably 0.01 to 0.2 μm. When the thickness is too thin, coating nonuniformity of the product tends to be caused because it is hard to apply a coating material uniformly. When the thickness is too thick, inferior antistatic ability and resistance to scratching can be caused sometimes.

The pH of a coating film in the silver halide color photographic light-sensitive material of the present invention is preferably 4.6 to 6.4, and more preferably 5.5 to 6.5. When the pH of the coating film is too high, in a sample long under the lapse of time, a cyan image and a magenta image are greatly sensitized by irradiation with safelight. On the contrary, when the pH of the coating film is too low, the density of a yellow image largely changes with a change in the time elapsing since the light-sensitive material is exposed until it is developed. Either of the cases poses practical problems.

The term "pH of coating film" in the silver halide color photographic light-sensitive material of the present invention means the pH of all photographic layers obtained by applying each coating solution to the support, and it does not always coincides with the pH of the individual coating solution. The pH of coating film can be measured by the following method as described in JP-A-61-245153. Specifically, (1) 0.05 ml of pure water is added dropwise to the surface of a light-sensitive material on the side to which silver halide emulsions are applied; and then (2) after it is allowed to stand for 3 minutes, the pH of coating film is measured using a surface pH measuring electrode (GS-165F, trade name, manufactured by Towa Denpa). The pH of coating film can be adjusted using an acid (e.g., sulfuric acid or citric acid) or an alkali (e.g., sodium hydroxide or potassium hydroxide), if necessary.

According to the present invention, it is possible to provide a silver halide color photographic light-sensitive material for movie which is excellent in stability of the density at a white portion even when the material is subjected to a simplified processing wherein the use of sound signal recording based on cyan dye sound technique is premised.

The present invention will be described in more detail based on examples given below, but the invention is not meant to be limited by these examples.

EXAMPLES

Example 1

(Preparation of Support)

A polyethylene terephthalate film support (thickness: 120 μm), provided with an undercoat on the side of the surface to which emulsions were to be applied, and also provided with an acrylic resin layer which contained the following conductive polymer (0.05 g/m$^2$) and tin oxide fine particles (0.20 g/m$^2$), on the side opposite to the surface to which emulsions were to be applied, was prepared.

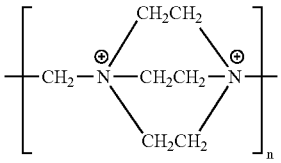

Electrically conductive polymer (Preparation of Silver Halide Emulsions)

Preparation of blue-sensitive silver halide emulsions

Large-size Emulsion (BO-01)

(Cube, grain size 0.71 μm, grain size distribution 0.09, halogen composition Br/Cl=3/97)

This emulsion was prepared by addition of an aqueous silver nitrate solution and an aqueous mixed solution of sodium chloride and potassium bromide by the control double jet method known in the art. The iridium content was adjusted so that it would be $4\times10^{-7}$ mol/mol Ag. To this emulsion were added the sensitizing dyes (A') to (C') represented by the structural formulae which will be shown later, as follows.

Blue-sensitive sensitizing dye (A'): $3.5\times10^{-5}$ mol/mol Ag

Blue-sensitive sensitizing dye (B'): $1.9\times10^{-4}$ mol/mol Ag

Blue-sensitive sensitizing dye (C'): $1.8\times10^{-5}$ mol/mol Ag

Further, the emulsion was optimally gold-sulfur sensitized using chloroauric acid and triethylthiourea.

Middle-size Emulsion (BM-01)

(Cube, grain size 0.52 μm, grain size distribution 0.09, halogen composition Br/Cl=3/97)

This emulsion was prepared by addition of an aqueous silver nitrate solution and an aqueous mixed solution of sodium chloride and potassium bromide by the control double jet method known in the art. The iridium content was adjusted so that it would be $6\times10^{-7}$ mol/mol Ag. To this emulsion were added the sensitizing dyes (A') to (C') represented by the structural formulae, which will be shown later, as follows.

Blue-sensitive sensitizing dye (A'): $6.9\times10^{-5}$ mol/mol Ag

Blue-sensitive sensitizing dye (B'): $2.3\times10^{-4}$ mol/mol Ag

Blue-sensitive sensitizing dye (C'): $2.7\times10^{-5}$ mol/mol Ag

Further, the emulsion was optimally gold-sulfur sensitized using chloroauric acid and triethylthiourea.

Small-size Emulsion (BU-01)

(Cube, grain size 0.31 μm, grain size distribution 0.08, halogen composition Br/Cl=3/97)

This emulsion was prepared in the same manner as BM-01, except that, in the preparation of BM-01 emulsion, the grain formation temperature was lowered.

The sensitizing dyes (A') to (C') represented by the structural formulae which will be shown later, were added as follows.

Blue-sensitive sensitizing dye (A'): $8.5\times10^{-4}$ mol/mol Ag

Blue-sensitive sensitizing dye (B'): $4.1\times10^{-4}$ mol/mol Ag

Blue-sensitive sensitizing dye (C'): $3.7\times10^{-5}$ mol/mol Ag

Preparation of red-sensitive silver halide emulsions

Large-size Emulsion (RO-01)

(Cube, grain size 0.23 μm, grain size distribution 0.11, halogen composition Br/Cl=25/75)

This emulsion was prepared by addition of an aqueous silver nitrate solution and an aqueous mixed solution of sodium chloride and potassium bromide by the control double jet method known in the art. The iridium content was adjusted so that it would be $2\times10^{-7}$ mol/mol Ag. To this emulsion were added the sensitizing dyes (D') to (F') represented by the structural formulae which will be shown later, as follows, to effect spectral sensitization.

Red-sensitive sensitizing dye (D'): $4.5\times10^{-5}$ mol/mol Ag

Red-sensitive sensitizing dye (E'): $0.2\times10^{-5}$ mol/mol Ag

Red-sensitive sensitizing dye (F'): $0.1\times10^{-5}$ mol/mol Ag

Furthermore, this emulsion was optimally gold-sulfur sensitized with chloroauric acid and triethylthiourea, and thereafter Cpd-71 represented by the structural formula which will be shown later, was added in an amount of $9.0\times10^{-4}$ mol per mol of silver halide.

Middle-size Emulsion (RM-01)

(Cube, grain size 0.174 μm, grain size distribution 0.12, halogen composition Br/Cl=25/75)

This emulsion was prepared in the same manner as RO-01, except that the grain formation temperature was changed. The sensitizing dyes (D') to (F') represented by the structural formulae which will be shown later, were used as follows.

Red-sensitive sensitizing dye (D'): $7.0\times10^{-5}$ mol/mol Ag

Red-sensitive sensitizing dye (E'): $1.0\times10^{-5}$ mol/mol Ag

Red-sensitive sensitizing dye (F'): $0.4\times10^{-5}$ mol/mol Ag

Small-size Emulsion (RU-01)

(Cube, grain size 0.121 μm, grain size distribution 0.13, halogen composition Br/Cl=25/75)

This emulsion was prepared in the same manner as RO-01, except that the grain formation temperature was changed. The sensitizing dyes (D') to (F') represented by the structural formulae which will be shown later, were used as follows.

Red-sensitive sensitizing dye (D'): $8.9\times10^{-5}$ mol/mol Ag

Red-sensitive sensitizing dye (E'): $1.2\times10^{-5}$ mol/mol Ag

Red-sensitive sensitizing dye (F'): $0.5\times10^{-5}$ mol/mol Ag

Preparation of green-sensitive silver halide emulsions

Large-size Emulsion (GO-01)

(Cube, grain size 0.20 μm, grain size distribution 0.11, halogen composition Br/Cl=3/97)

This emulsion was prepared by addition of an aqueous silver nitrate solution, an aqueous mixed solution of sodium chloride and potassium bromide by the control double jet method known in the art. The iridium content was adjusted so that it would be $2\times10^{-7}$ mol/mol Ag. To this emulsion were added the sensitizing dyes (G') to (J') represented by the structural formulae which will be shown later, as follows, to effect spectral sensitization.

Green-sensitive sensitizing dye (G'): $2.8\times10^{-4}$ mol/mol Ag

Green-sensitive sensitizing dye (H'): $0.8\times10^{-4}$ mol/mol Ag

Green-sensitive sensitizing dye (I'): $1.2\times10^{-4}$ mol/mol Ag

Green-sensitive sensitizing dye (J'): $1.2\times10^{-4}$ mol/mol Ag

Further, the emulsion was optimally gold-sulfur sensitized using chloroauric acid and triethylthiourea.

Middle-size Emulsion (GM-01)

(Cube, grain size 0.146 μm, grain size distribution 0.12, halogen composition Br/Cl=3/97)

This emulsion was prepared in the same manner as GO-01, except that the grain formation temperature was changed. The sensitizing dyes (G') to (J') represented by the structural formulae which will be shown later, were used as follows.

Green-sensitive sensitizing dye (G'): $3.8\times10^{-4}$ mol/mol Ag

Green-sensitive sensitizing dye (H'): $1.3\times10^{-4}$ mol/mol Ag

Green-sensitive sensitizing dye (I'): $1.4\times10^{-4}$ mol/mol Ag

Green-sensitive sensitizing dye (J'): $1.2\times10^{-4}$ mol/mol Ag

Small-size Emulsion (GU-01)

(Cube, grain size 0. 102 μm, grain size distribution 0.10, halogen composition Br/Cl=3/97)

This emulsion was prepared in the same manner as GO-0 1, except that the grain formation temperature was changed. The sensitizing dyes (G') to (J') represented by the structural formulae which will be shown later, were used as follows.

Green-sensitive sensitizing dye (G'): $5.1\times10^{-4}$ mol/mol Ag

Green-sensitive sensitizing dye (H'): $1.7\times10^{-4}$ mol/mol Ag

Green-sensitive sensitizing dye (I'): $1.9\times10^{-4}$ mol/mol Ag

Green-sensitive sensitizing dye (J'): $1.2\times10^{-4}$ mol/mol Ag

Sensitizing dye (A')

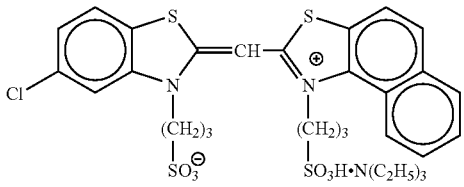

-continued

Sensitizing dye (B')

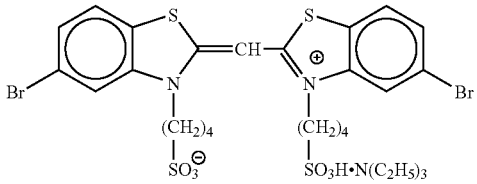

Sensitizing dye (C')

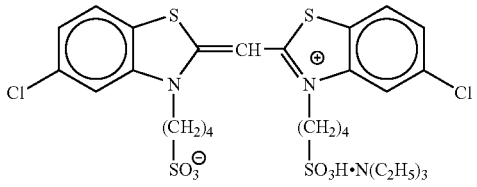

Sensitizing dye (D')

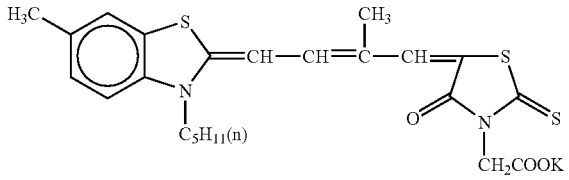

Sensitizing dye (E')

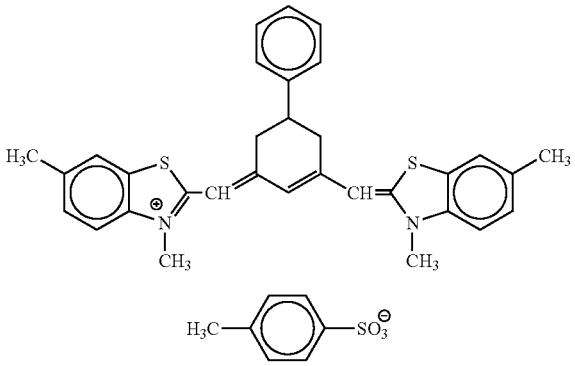

Sensitizing dye (F')

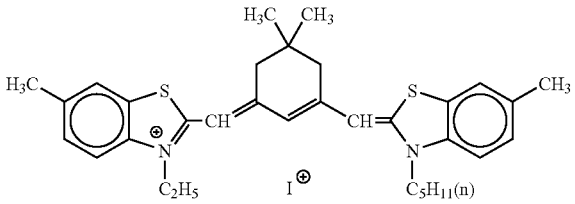

Sensitizing dye (G')

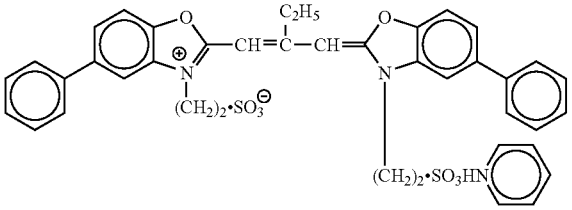

-continued

Sensitizing dye (H′)

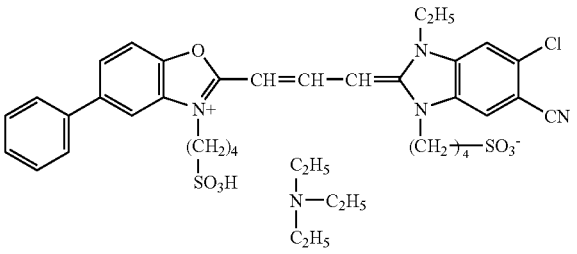

Sensitizing dye (I′)

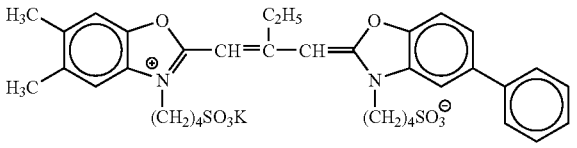

Sensitizing dye (J′)

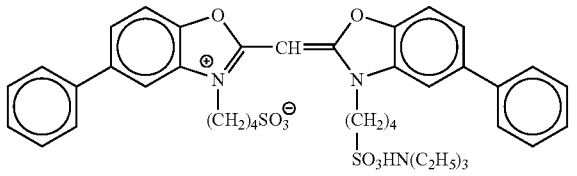

-continued (Cpd-71)

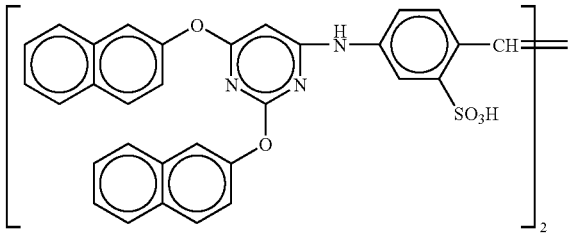

(Preparation of a Solid Fine-particle Dispersion of Dye)

A methanol wet cake of the compound (HD-1) shown below was weighed such that the net amount of the compound was 240 g, and 48 g of the compound (Pm-1) as a dispersing aid was weighed. To the compounds was added water such that the total amount was 4000 g. The mixture was crushed at a discharge rate of 0.51/min and a peripheral velocity of 10 m/s for 2 hours by using a flow-system sand-grinder mill (UVM-2) (trade name, manufactured by AIMEX K.K.) filled with 1.7 liters of zirconia beads (diameter: 0.5 mm). Then, the dispersion was diluted such that the concentration of the compound was 3 mass %, and Compound (Pm-1) having the below shown structure was added in an amount of 3% in terms of mass ratio to the dye (this dispersion will be referred to as Dispersion A). The average particle size of this dispersion was 0.45 μm.

Further, a dispersion, which contained 5 mass % of Compound (HD-2) shown below, was prepared in the same manner as above (this will be referred to as Dispersion B).

(HD-1)

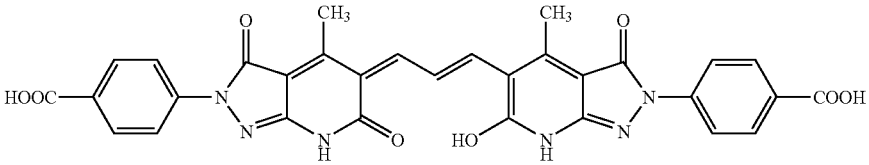

(HD-2)

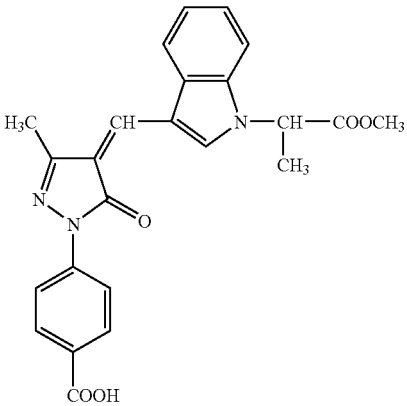

Pm-1

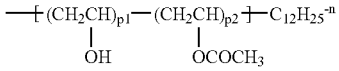

$p_1$ = 88 mol %
$p_2$ = 12 mol %
Polymerization degree 300

(Preparation of Sample 100)

Each layer having the composition shown below was applied to the support by multilayer-coating, thereby producing a multilayer color photographic light-sensitive material as Sample 100.

(Preparation of Coating Solution for Sixth Layer)

75.0 g of a magenta coupler (ExM), 1.5 g of an additive (Cpd-49), 0.1 g of an additive (Cpd-51), and 2.3 g of an additive (Cpd-55) were dissolved in 15 g of a solvent (Solv-21) and 80 ml of ethyl acetate. The solution was emulsified and dispersed in 1000 g of an aqueous 10% gelatin solution containing 20 ml of 10% solution of an additive (Cpd-52), to prepare an emulsified dispersion M.

The above emulsified dispersion M and the silver chlorobromide emulsion were mixed and dissolved, to prepare a coating solution for a sixth layer such that the solution had the following composition.

On the other hand, the above-mentioned silver chlorobromide emulsions GO-01, GM-01, and GU-01 were mixed and dissolved with the emulsified dispersion M, to prepare a sixth layer coating solution having a composition described below. Coating solutions for first to fifth layers and seventh layer were also prepared in the same manner as the coating solution for sixth layer.

Layer constitution

The composition of each layer is shown below. The numerals show the respective amounts (g/m$^2$) to be applied. As the amount of the silver halide emulsion, an amount converted into that of silver is shown. As a gelatin hardener, a sodium salt of 1-oxy-3,5-dichloro-s-triazine was used.

(Layer Constitution of Sample 100)

Support

Polyethylene terephthalate film

| First layer (halation preventive layer (non-light-sensitive hydrophilic colloid layer)) | |
|---|---|
| Gelatin | 1.10 |
| The above Dispersion A (in terms of coating amount of HD-1) | 0.15 |
| The above Dispersion B (in terms of coating amount of HD-2) | 0.09 |

| Second layer (blue light-sensitive silver halide emulsion layer) | |
|---|---|
| A mixture of silver chlorobromide emulsions BO-01, BM-01, and BU-01, mixed in a ratio of 3:1:6 (mol ratio of silver) | 0.57 |
| Gelatin | 2.71 |
| Yellow coupler (ExY') | 1.19 |
| (Cpd-41) | 0.0006 |
| (Cpd-42) | 0.01 |
| (Cpd-43) | 0.04 |
| (Cpd-44) | 0.006 |
| (Cpd-45) | 0.017 |
| (Cpd-46) | 0.002 |
| (Cpd-52) | 0.07 |
| (Cpd-54) | 0.08 |
| (Cpd-63) | 0.02 |
| Solvent (Solv-21) | 0.26 |

| Third Layer (color-mixing inhibiting layer) | |
|---|---|
| Gelatin | 0.56 |
| (Cpd-49) | 0.02 |
| (Cpd-43) | 0.05 |
| (Cpd-52) | 0.01 |
| (Cpd-53) | 0.005 |
| (Cpd-61) | 0.02 |
| (Cpd-62) | 0.05 |
| Solvent (Solv-21) | 0.05 |
| Solvent (Solv-23) | 0.04 |
| Solvent (Solv-24) | 0.001 |

| Fourth layer (red light-sensitive silver halide emulsion layer) | |
|---|---|
| A mixture of silver chlorobromide emulsions RO-01, RM-01, and RU-01, mixed in a ratio of 2:2:6 (mol ratio of silver) | 0.39 |
| Gelatin | 2.7 |
| Cyan coupler (ExC') | 0.75 |
| (Cpd-47) | 0.06 |
| (Cpd-48) | 0.06 |
| (Cpd-50) | 0.03 |
| (Cpd-52) | 0.04 |
| (Cpd-53) | 0.03 |
| (Cpd-55) | 0.03 |
| (Cpd-57) | 0.05 |
| (Cpd-58) | 0.007 |
| (Cpd-60) | 0.02 |
| Solvent (Solv-21) | 0.51 |
| Solvent (Solv-22) | 0.28 |
| Solvent (Solv-23) | 0.03 |

| Fifth Layer (color-mixing inhibiting layer) | |
|---|---|
| Gelatin | 0.56 |
| (Cpd-49) | 0.02 |
| (Cpd-43) | 0.05 |
| (Cpd-52) | 0.01 |
| (Cpd-53) | 0.005 |
| (Cpd-62) | 0.05 |
| (Cpd-64) | 0.002 |
| Solvent (Solv-21) | 0.05 |
| Solvent (Solv-23) | 0.04 |
| Solvent (Solv-24) | 0.001 |

| Sixth Layer (green light-sensitive silver halide emulsion layer) | |
|---|---|
| A mixture of silver chlorobromide emulsions GO-01, GM-01, GU-01, mixed in a ratio of 1:3:6 (mol ratio of silver) | 0.54 |
| Gelatin | 1.66 |
| Magenta coupler (ExM') | 0.73 |
| (Cpd-49) | 0.013 |
| (Cpd-51) | 0.001 |
| (Cpd-52) | 0.02 |
| (Cpd-55) | 0.02 |
| Solvent (Solv-21) | 0.15 |

| Seventh Layer (protective layer) | |
|---|---|
| Gelatin | 0.97 |
| Acrylic resin (av. particle diameter, 2 μm) | 0.002 |
| (Cpd-55) | 0.03 |
| (Cpd-56) | 0.08 |
| (Cpd-59) | 0.001 |
Herein, the compounds used are shown below.
ExY′
(1)
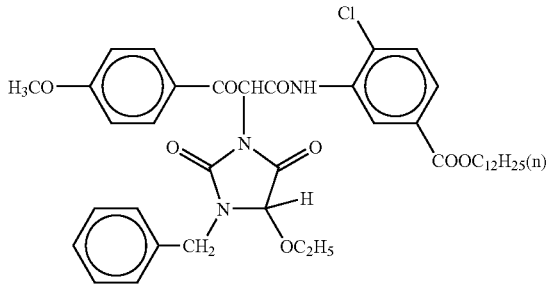
(2)
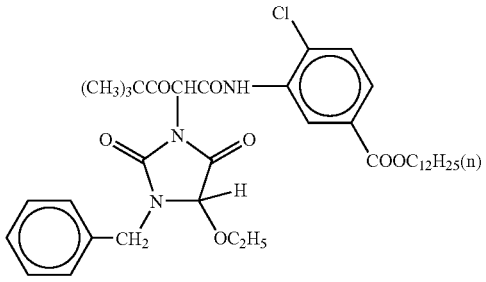
(3)
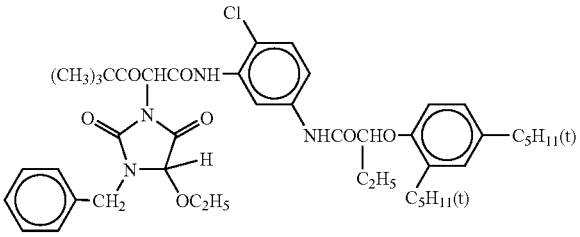
A mixture in 80:10:10 (molar ratio) of (1), (2), and (3)
ExC′
(1)
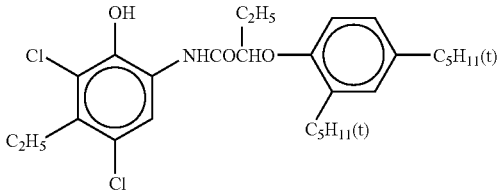
-continued
(2)
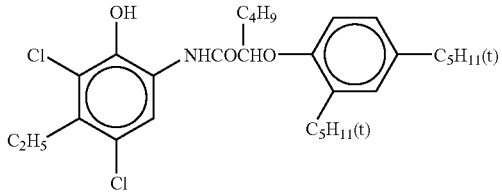
(3)
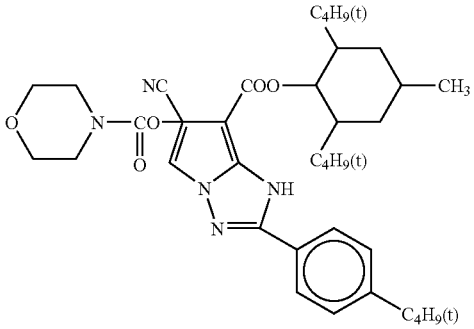
(4)
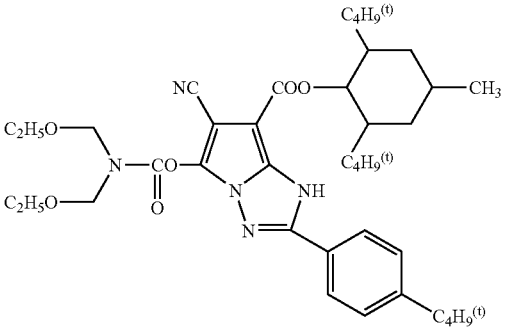
A mixture in 40:40:10:10 (molar ratio) of (1), (2), (3), and (4)
ExM′
(1)
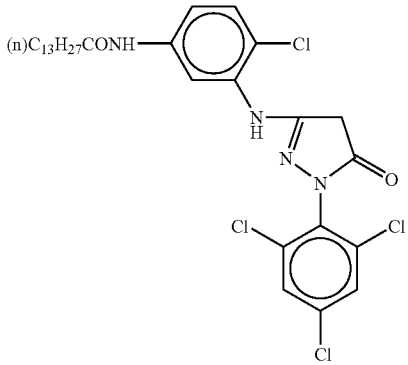
(2)
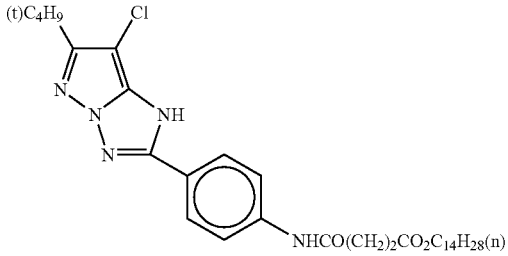

-continued
(3)
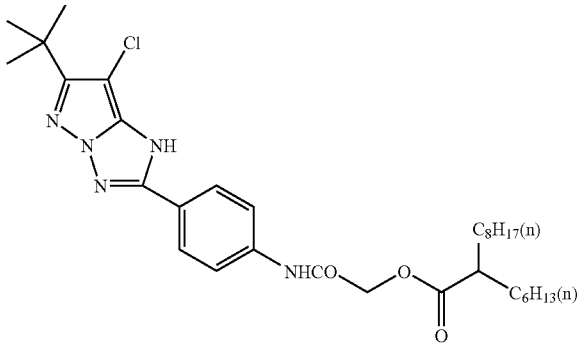
A mixture in 90:5:5 (molar ratio) of (1), (2), and (3)
(Cpd-41)
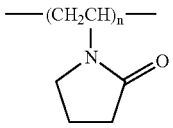
(Cpd-42)
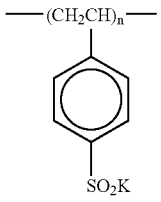
(Cpd-43)
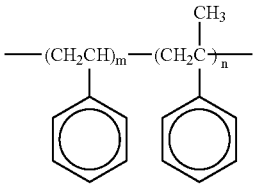
Number-average molecular weight 600
m/n = 10/90
(Cpd-44)
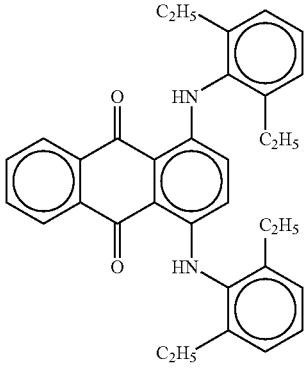
-continued
(Cpd-45)
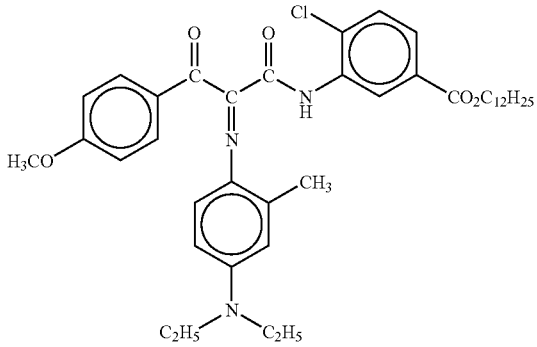
(Cpd-46)
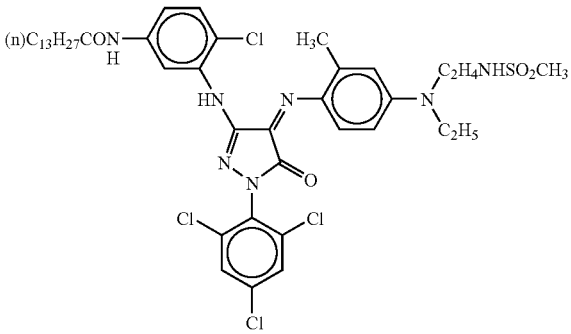
(Cpd-47)
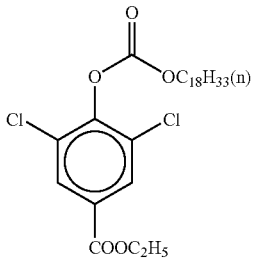
(Cpd-48)
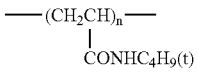
Average molecular weight about 60. 000
(Cpd-49)
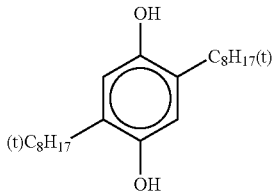

-continued
(Cpd-50)
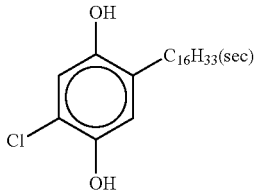
(Cpd-51)
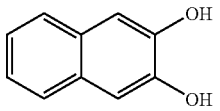
(Cpd-52)
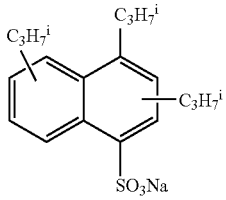
(Cpd-53)
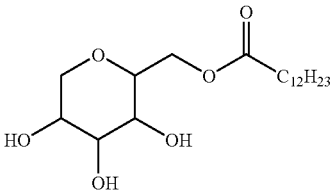
(Cpd-54)
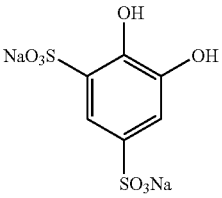
(Cpd-55)
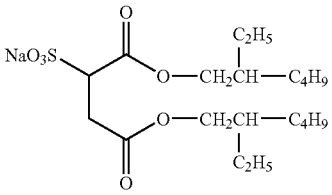
(Cpd-56)
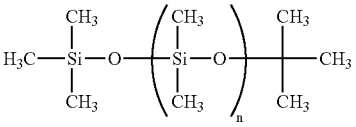
(Cpd-57)
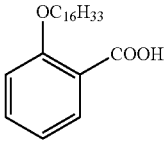
-continued
(Cpd-58)
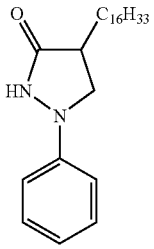
(Cpd-59)
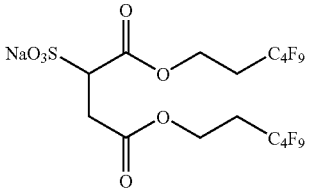
(Cpd-60)
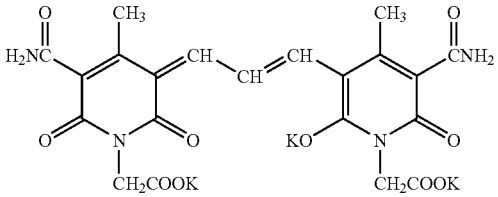
(Cpd-61)
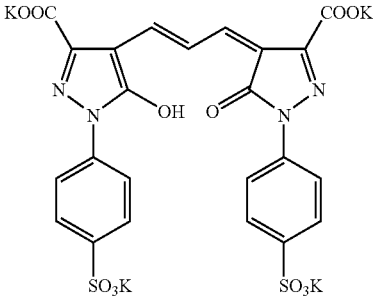
(Cpd-62)
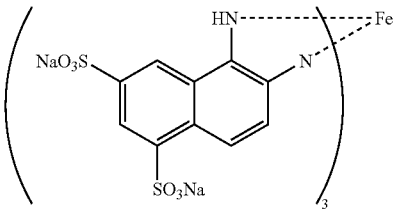
(Cpd-63)
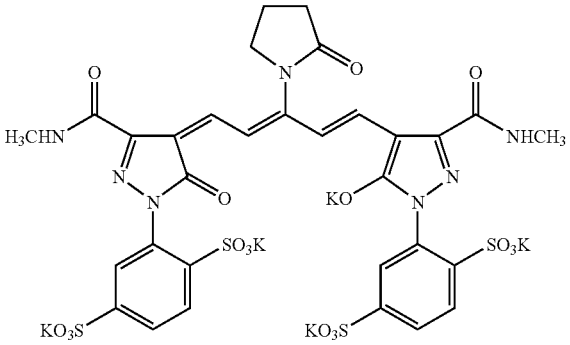

-continued (Cpd-64)

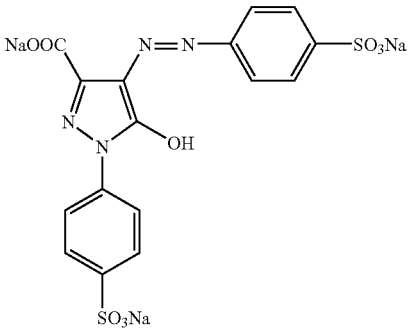

(Solv-21)

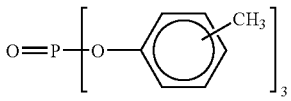

(Solv-22)

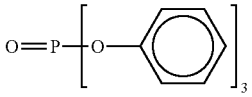

(Solv-23)

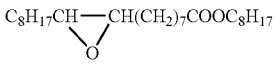

(Solv-24)

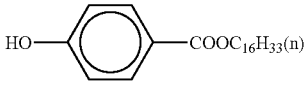

In the above manner, Sample 100 was prepared.

(Preparation of Sample 101)

Next, a sample 101 was prepared in the same manner as in the production of the light-sensitive material 100, except that the composition of the first layer was changed to a composition described below.

| First layer (halation preventive layer) | |
|---|---|
| Gelatin | 1.03 |
| Black colloidal silver (in terms of coating amount of silver) | 0.18 |

(Preparation of Sample 102)

Sample 102 was prepared in the same manner as the light-sensitive material 101, except that a non-light-sensitive hydrophilic colloidal layer (intermediate layer) of a composition described below was further inserted between the first layer and the second layer.

| Intermediate layer (non-light-sensitive) | |
|---|---|
| Gelatin | 0.70 |
| (Cpd-49) | 0.01 |
| (Cpd-43) | 0.03 |
| (Cpd-52) | 0.01 |
| (Cpd-53) | 0.003 |
| Solvent (Solv-21) | 0.08 |
| Solvent (Solv-23) | 0.05 |

(Preparation of Samples 103 to 110)

Samples 103 to 110 were each formed in the same manner as in the production of the light-sensitive material 101, except that the following were changed as shown in Table 2: the halogen composition of the light-sensitive silver halide emulsion in the second layer; whether or not an intermediate layer used in the sample 102 was formed; the coating amount of the colloidal silver in the first layer; and the Fe mount in the light-sensitive material. The Fe amount was adjusted mainly by changing the coating amount of Compound Cpd-62.

TABLE 2

| | First layer | | | | | |
|---|---|---|---|---|---|---|
| Sample No. | Species | Coating amount of silver | Intermediate layer | Silver chloride content in the second layer | Fe amount (mol/m$^2$) | Remarks |
| 100 | Dye solid dispersion | — | Not formed | 98% | $9 \times 10^{-5}$ | Comparative example |
| 101 | Colloidal silver | 0.18 g/m$^2$ | Not formed | 98% | $9 \times 10^{-5}$ | Comparative example |
| 102 | Colloidal silver | 0.18 g/m$^2$ | Formed | 98% | $9 \times 10^{-5}$ | Comparative example |
| 103 | Colloidal silver | 0.18 g/m$^2$ | Formed | 75% | $9 \times 10^{-5}$ | Comparative example |
| 104 | Colloidal silver | 0.18 g/m$^2$ | Not formed | 75% | $9 \times 10^{-5}$ | Comparative example |
| 105 | Colloidal silver | 0.18 g/m$^2$ | Formed | 98% | $6 \times 10^{-5}$ | This invention |
| 106 | Colloidal silver | 0.18 g/m$^2$ | Formed | 98% | $8 \times 10^{-6}$ | This invention |
| 107 | Colloidal silver | 0.18 g/m$^2$ | Not formed | 98% | $6 \times 10^{-5}$ | This invention |
| 108 | Colloidal silver | 0.18 g/m$^2$ | Not formed | 98% | $8 \times 10^{-6}$ | This invention |
| 109 | Colloidal silver | 0.25 g/m$^2$ | Not formed | 98% | $8 \times 10^{-6}$ | This invention |
| 110 | Colloidal silver | 0.18 g/m$^2$ | Not formed | 98% | $2 \times 10^{-6}$ | This invention |

(Preparation of Processing Solutions)

The following processing process was prepared based on the ECP-2D process published from Eastman Kodak, as a standard method for processing a motion picture color positive film, but with the modification that the sound development step was excluded from the ECP-2D process. Then, for the purpose of preparing a development process condition in a running equilibrium state, all samples prepared as above were respectively exposed to such an image that about 30% of the amount of coated silver would be developed, and then each sample finished with the exposure was subjected to continuous processing (running test) performed according to the following processing process, until the amount of the replenisher solution in the color developing bath became twice the tank volume.

ECP-2D Process (Excluding the Sound Developing Step)

<Step>

| Name of step | Process temp. (° C.) | Process time (sec) | Replenisher amount (ml per 35 mm × 30.48 m) |
|---|---|---|---|
| 1. Developing | 36.7 ± 0.1 | 180 | 690 |
| 2. Stop | 27 ± 1 | 40 | 770 |
| 3. Washing | 27 ± 3 | 40 | 1200 |
| 4. First fixing | 27 ± 1 | 40 | 200 |
| 5. Washing | 27 ± 3 | 40 | 1200 |
| 6. Bleaching | 27 ± 1 | 60 | 200 |
| 7. Washing | 27 ± 3 | 40 | 1200 |
| 8. Second fixing | 27 ± 1 | 40 | 200 |
| 9. Washing | 27 ± 3 | 60 | 1200 |
| 10. Rinsing | 27 ± 3 | 10 | 400 |
| 11. Drying | | | |

<Formulation of Process Solutions>

Composition per 1 liter is shown.

| Name of steps | Name of chemicals | Tank solution | Replenisher solution |
|---|---|---|---|
| Developing | Kodak Anti-calcium No. 4 (trade name) | 1.0 ml | 1.4 ml |
| | Sodium sulfite | 4.35 g | 4.50 g |
| | CD-2 | 2.95 g | 6.00 g |
| | Sodium carbonate | 17.1 g | 18.0 g |
| | Sodium bromide | 1.72 g | 1.60 g |
| | Sodium hydroxide | — | 0.6 g |
| | Sulfuric acid (7N) | 0.62 ml | — |
| Stop | Sulfuric acid (7N) | 50 ml | 50 ml |
| Fixing (common to the first fixing and the second fixing) | | | |
| | Ammonium thiosulfate (58%) | 100 ml | 170 ml |
| | Sodium sulfite | 2.5 g | 16.0 g |
| | Sodium hydrogen sulfite | 10.3 g | 5.8 g |
| | Potassium iodide | 0.5 g | 0.7 g |
| Bleaching | Proxel GXL | 0.07 ml | 0.10 ml |
| | Aqueous ammonia (28%) | 54.0 ml | 64.0 ml |
| | PDTA | 44.8 g | 51.0 g |
| | Ammonium bromide | 23.8 g | 30.7 g |
| | Acetic acid (90%) | 10.0 ml | 14.5 ml |
| | Ferric nitrate anhydride | 53.8 g | 61.2 g |
| Rinsing | Kodak Stabilizer Additive | 0.14 ml | 0.17 ml |
| | Dearcide 702 | 0.7 ml | 0.7 ml |

In the above, CD-2 used in the developing step is a developing agent, and Dearcide 702 used in the rinsing step is a mildewproof agent. The processing using the thus obtained processing solutions in running equilibrium conditions is referred to as Processing A.

A processing process was prepared in the same manner as process A, except that the steps were changed as follows. Also in this processing process, for the purpose of preparing a development process condition in a running equilibrium state, all samples prepared as above were respectively exposed to such an image that about 30% of the amount of coated silver would be developed, and then each sample which had been exposed was subjected to continuous processing (running test) performed according to the following processing process, until the amount of the replenisher solution in the color developing bath became twice the tank volume. The processing using the thus obtained processing solutions in running equilibrium conditions is referred to as Processing B.

<Step of Process B>

<Step>

| Name of step | Process temp. (° C.) | Process time (sec) | Replenisher amount (ml per 35 mm × 30.48 m) |
|---|---|---|---|
| 1. Developing | 39.0 ± 0.1 | 120 | 690 |
| 2. Stop | 27 ± 1 | 40 | 770 |
| 3. Washing | 27 ± 3 | 40 | 1200 |
| 4. Bleaching | 27 ± 1 | 60 | 200 |
| 5. Washing | 27 ± 3 | 40 | 1200 |
| 6. Fixing | 27 ± 1 | 60 | 200 |
| 7. Washing | 27 ± 3 | 60 | 1200 |
| 8. Rinsing | 27 ± 3 | 10 | 400 |
| 9. Drying | | | |

In the processing B, the formulation of the processing solution in each of the baths was the same as in the processing A.

[Evaluation of the Samples]

Each sample was exposed using a sensitometer (FWH Model, manufactured by Fuji Photo Film Co., Ltd., color temperature of a light source: 3200 K) through yellow- and magenta- color correction filters and an optical wedge which varied in optical density in steps of 0.2 per 5 mm, so as to obtain a neutral gray sensitometry image by the processing A.

About each of the resultant processed samples, a device, Xrite 310 (trade name) manufactured by Xrite Co. under conditions of status A was used to measure the yellow density (Dmin(B)) of its white portion, and the yellow density (Dmax (B)) of its maximum color formation density portion. The measured values were used as values for evaluating the density fluctuation of the white portion and the suitability for simplifed processing, respectively. As the Dmin(B) value is lower, the density fluctuation of the white portion is smaller. As a sample has a higher Dmax(B), the sample is better in suitability for simplified processing. The results are shown in Table 3.

TABLE 3

| | Process A | | Process B | | |
|---|---|---|---|---|---|
| Sample No. | Dmin (B) | Dmax (B) | Dmin (B) | Dmax (B) | Remarks |
| 100 | 0.21 | 3.78 | 0.52 | 4.12 | Comparative example |
| 101 | 0.37 | 3.81 | 0.41 | 3.95 | Comparative example |
| 102 | 0.34 | 3.72 | 0.39 | 3.85 | Comparative example |
| 103 | 0.23 | 3.76 | 0.26 | 3.17 | Comparative example |
| 104 | 0.22 | 3.80 | 0.23 | 3.23 | Comparative example |
| 105 | 0.24 | 3.73 | 0.25 | 3.83 | This invention |
| 106 | 0.21 | 3.74 | 0.23 | 3.83 | This invention |
| 107 | 0.25 | 3.82 | 0.27 | 3.96 | This invention |

TABLE 3-continued

| Sample No. | Process A Dmin (B) | Process A Dmax (B) | Process B Dmin (B) | Process B Dmax (B) | Remarks |
|---|---|---|---|---|---|
| 108 | 0.21 | 3.80 | 0.24 | 3.94 | This invention |
| 109 | 0.22 | 3.79 | 0.25 | 3.94 | This invention |
| 110 | 0.21 | 3.80 | 0.23 | 3.95 | This invention |

[Evaluation Results]

In the standard process (process A), sample 101, in which a dye solid dispersion was used in its first layer, exhibited satisfactory values for the density at the white portion and density at the maximum color formation density portion; however, in the simplified process (process B), the density at the white portion was high. Thus, the sample 100 was unsuitable for the process B. The sample wherein colloidal silver was introduced into its first layer, such as the sample 101 or 102, exhibited a high density at the white portion through the standard process and the simplified process. On the other hand, about the sample wherein the silver chloride content in the silver halide emulsion used in its second layer was lowered, such as the sample 103 or 104, the density at the white portion was decreased but the maximum color formation density fell through the process B. That is, the simplified process suitability was lost. However, with respect to any one of samples of the present invention, such as the samples 105 to 110, a decrease in the density at the white portion and the maintenance of the maximum color formation density were compatible with each other through both of the processes A and B. Further, from comparison of the sample 105 with the sample 107 and that of the sample 106 with the sample 108, it is understood that the samples having no intermediate layer (the samples 107 and 108) exhibited a slightly higher maximum color formation density, and are more preferable. Furthermore, it is understood from the comparison between the sample 107, 108 and 110 that it is more preferable to keep the Fe amount to $8\times10^{-6}$ mol/m$^2$ or less, in order to prevent a fluctuation of the density of the white portion.

Example 2

With respect to each of the samples 105 to 110 of the present invention, which was prepared in Example 1, the sound property in the case where the sample was subjected to the simplified process was evaluated by the following method.

First, prepared was a sound negative film (Panchromatic sound negative film No. 2374, manufactured by Eastman Kodak Co.) wherein sound signals having frequencies of 60, 100, 400, 1000, 2000, 4000, and 16000 Hz were recorded in a Dolby-A format. This film was used to expose a cyan dye soundtrack onto each of the samples 105 to 110 under appropriate light-exposure conditions. The light-exposure conditions and the density in the sound negative film were decided beforehand in a cross modulation test. The resultant samples were processed through the process B in Example 1, and then the signals of the cyan dye soundtrack were reproduced by means of a film projector equipped with a reader for cyan dye soundtrack (Cineforward projector, manufactured by Nippon Densi Kogaku Co., Ltd.). The intensities of the reproduced signals having the individual frequencies were compared with each other. As a result, about each of the samples, a fluctuation in the intensity of each of the reproduced signals having the frequencies up to 4000 Hz was within 0.5 dB from the intensity of the reproduced signal having the frequency of 100 Hz. The amount of a reduction in the intensity of the reproduced signal having the frequency of 16000 Hz was 7 dB or less. It is understood from this fact that any sample of the present invention had a frequency characteristic which was flat in the frequency range of 60 to 4000 Hz and which reproduced signals in a high-frequency range sufficiently even if the sample was subjected to the simplified process.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority on Patent Application No. 2006-088673 filed in Japan on Mar. 28, 2006, which is herein incorporated by reference.

What I claim is:

1. A silver halide color photographic light-sensitive material, which is for use in movie projection, which comprises:

on a transparent support, at least three kinds of light-sensitive silver halide emulsion layers that are different from each other in color developability and color sensitivity and which three kinds of layers include at least one yellow color-forming light-sensitive silver halide emulsion layer, at least one cyan color-forming light-sensitive silver halide emulsion layer, and at least one magenta color-forming light-sensitive silver halide emulsion layer, respectively, and at least one non-light-sensitive hydrophilic colloid layer, wherein, among the light-sensitive silver halide emulsion layers, the layer nearest to the support includes silver halide emulsion grains having a silver halide composition of silver chlorobromide, silver chloroiodide, silver chloroiodobromide, or silver chloride, each having a silver chloride content of 95% or more by mol, wherein the silver halide color photographic light-sensitive material further comprises at least one non-light-sensitive hydrophilic colloid layer containing black colloidal silver between the support and the light-sensitive silver halide emulsion layer nearest to the support, and wherein an amount of Fe in the silver halide color photographic light-sensitive material is $6\times10^{-5}$ mol/m$^2$ or less.

2. The silver halide color photographic light-sensitive material as claimed in claim 1, wherein the amount of Fe in the silver halide color photographic light-sensitive material is $8\times10^{-6}$ mol/m$^2$ or less.

3. The silver halide color photographic light-sensitive material as claimed in claim 1, wherein each of the light-sensitive silver halide emulsion layers includes silver halide emulsion grains having a silver halide composition of silver chlorobromide, silver chloroiodide, silver chloroiodobromide, or silver chloride, each having a silver chloride content of 95% or more by mol.

4. The silver halide color photographic light-sensitive material as claimed in claim 1, wherein the silver halide emulsion layer nearest to the support is adjacent to the non-light-sensitive hydrophilic colloid layer containing the black colloidal silver.

5. The silver halide color photographic light-sensitive material as claimed in claim 1, wherein the coating amount of silver of the black colloidal silver in the silver halide color photographic light-sensitive material is from 0.01 to 2.0 g/m$^2$.

6. The silver halide color photographic light-sensitive material as claimed in claim 1, wherein the coating amount of silver of the black colloidal silver in the silver halide color photographic light-sensitive material is from 0.04 to 1.0 g/m$^2$.

* * * * *